US010700458B2

(12) United States Patent
Hirakawa et al.

(10) Patent No.: US 10,700,458 B2
(45) Date of Patent: Jun. 30, 2020

(54) ELECTRIC CONNECTOR AND CONNECTOR DEVICE

(71) Applicant: DAI-ICHI SEIKO CO., LTD., Kyoto (JP)

(72) Inventors: Takeshi Hirakawa, Machida (JP); Tadamichi Yayoshi, Machida (JP); Takahiro Fukushima, Machida (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/695,463

(22) Filed: Sep. 5, 2017

(65) Prior Publication Data

US 2018/0069331 A1 Mar. 8, 2018

(30) Foreign Application Priority Data

Sep. 7, 2016 (JP) ..... 2016-174776

(51) Int. Cl.
*H01R 12/71* (2011.01)
*H01R 12/00* (2006.01)
(Continued)

(52) U.S. Cl.
CPC ..... *H01R 12/716* (2013.01); *H01R 12/00* (2013.01); *H01R 12/57* (2013.01);
(Continued)

(58) Field of Classification Search
CPC ..... H01R 12/716
(Continued)

(56) References Cited

U.S. PATENT DOCUMENTS 7,946,888 B2 * 5/2011 Wu ..... H01R 12/716 439/626
8,052,457 B2 * 11/2011 Miyazaki ..... H01R 12/714 439/357
(Continued)

FOREIGN PATENT DOCUMENTS

CN 104934772 A 9/2015
DE 19518567 11/1996
(Continued)

OTHER PUBLICATIONS

An Office Action issued by the Japanese Patent Office dated Mar. 27, 2018, which corresponds to Japanese Patent Application No. 2016-174776 and is related to U.S. Appl. No. 15/695,463; with English translation.
(Continued)

*Primary Examiner* — Tulsidas C Patel
*Assistant Examiner* — Marcus E Harcum
(74) *Attorney, Agent, or Firm* — Studebaker & Brackett PC

(57) ABSTRACT

A receptacle connector includes a receptacle housing including a housing portion and receptacle terminals connected to plug terminals. The housing portion includes a first principal inner wall face, a second principal inner wall face, and a first-end inner wall face. At least a part of the first-end inner wall face is first receptacle guide faces having a gap width in a Y-axis direction gradually decreasing. The first receptacle guide face guides a plug connector such that the direction of an axial line of the plug connector is lined up in the direction of an axial line of the housing portion by regulating movement of the plug connector.

18 Claims, 17 Drawing Sheets

(51) Int. Cl.

| | |
|---|---|
| ***H01R 12/91*** | (2011.01) |
| ***H01R 13/64*** | (2006.01) |
| ***H01R 12/57*** | (2011.01) |
| ***H01R 12/70*** | (2011.01) |
| ***H01R 13/627*** | (2006.01) |
| ***H01R 13/629*** | (2006.01) |

(52) U.S. Cl.
CPC ..... *H01R 12/7005* (2013.01); *H01R 12/707* (2013.01); *H01R 12/91* (2013.01); *H01R 13/629* (2013.01); *H01R 13/6275* (2013.01); *H01R 13/64* (2013.01)

(58) Field of Classification Search
USPC ..... 439/74, 65, 66, 108
See application file for complete search history.

(56) References Cited

U.S. PATENT DOCUMENTS

| | | | | |
|---|---|---|---|---|
| 8,408,931 | B2 * | 4/2013 | Sato | H01R 12/7052 439/357 |
| 8,758,029 | B2 * | 6/2014 | Midorikawa | H01R 13/2407 439/74 |
| 8,845,339 | B2 * | 9/2014 | Ono | H01R 12/7052 439/74 |
| 9,124,011 | B2 * | 9/2015 | Miyazaki | H01R 12/716 |
| 9,178,309 | B2 * | 11/2015 | Tanaka | H01R 13/6271 |
| 2006/0276060 | A1 | 12/2006 | Takano | |
| 2012/0231637 | A1 * | 9/2012 | Takeuchi | H01R 12/716 439/65 |
| 2013/0210270 | A1 * | 8/2013 | Takeuchi | H01R 12/716 439/488 |
| 2015/0140841 | A1 * | 5/2015 | Watanabe | H01R 12/7011 439/74 |
| 2015/0263464 | A1 * | 9/2015 | Arichika | H01R 13/6271 439/374 |
| 2015/0270641 | A1 * | 9/2015 | Omodachi | H01R 12/707 439/374 |

FOREIGN PATENT DOCUMENTS

| | | | |
|---|---|---|---|
| EP | 2922147 | A1 | 9/2015 |
| FR | 1498269 | | 9/1967 |
| JP | 2005-026235 | A | 1/2005 |
| JP | 2006-344418 | A | 12/2006 |
| JP | 2007-018993 | A | 1/2007 |
| JP | 2007-323854 | A | 12/2007 |
| JP | 2010-129523 | A | 6/2010 |
| JP | 2015-115200 | A | 6/2015 |
| JP | 2015-185541 | A | 10/2015 |
| JP | 2015-216133 | A | 12/2015 |
| JP | 2015-220005 | A | 12/2015 |
| JP | 2016-058399 | A | 4/2016 |
| JP | 6404248 | B2 | 10/2018 |

OTHER PUBLICATIONS

A Chinese Office Action issued by the State Intellectual Property Office dated Nov. 5, 2018, which corresponds to Chinese Patent Application No. 201710789959.1 and is related to U.S. Appl. No. 15/695,463.

A Notification of Information Provision issued by the Japan Patent Office dated Feb. 19, 2019, which corresponds to Japanese Application No. 2018-165351 and is related to U.S. Appl. No. 15/695,463.

An Office Action mailed by the Japan Patent Office dated Nov. 26, 2019, which corresponds to Japanese Patent Application No. 2018-165351 and is related to U.S. Appl. No. 15/695,463; with English translation.

* cited by examiner

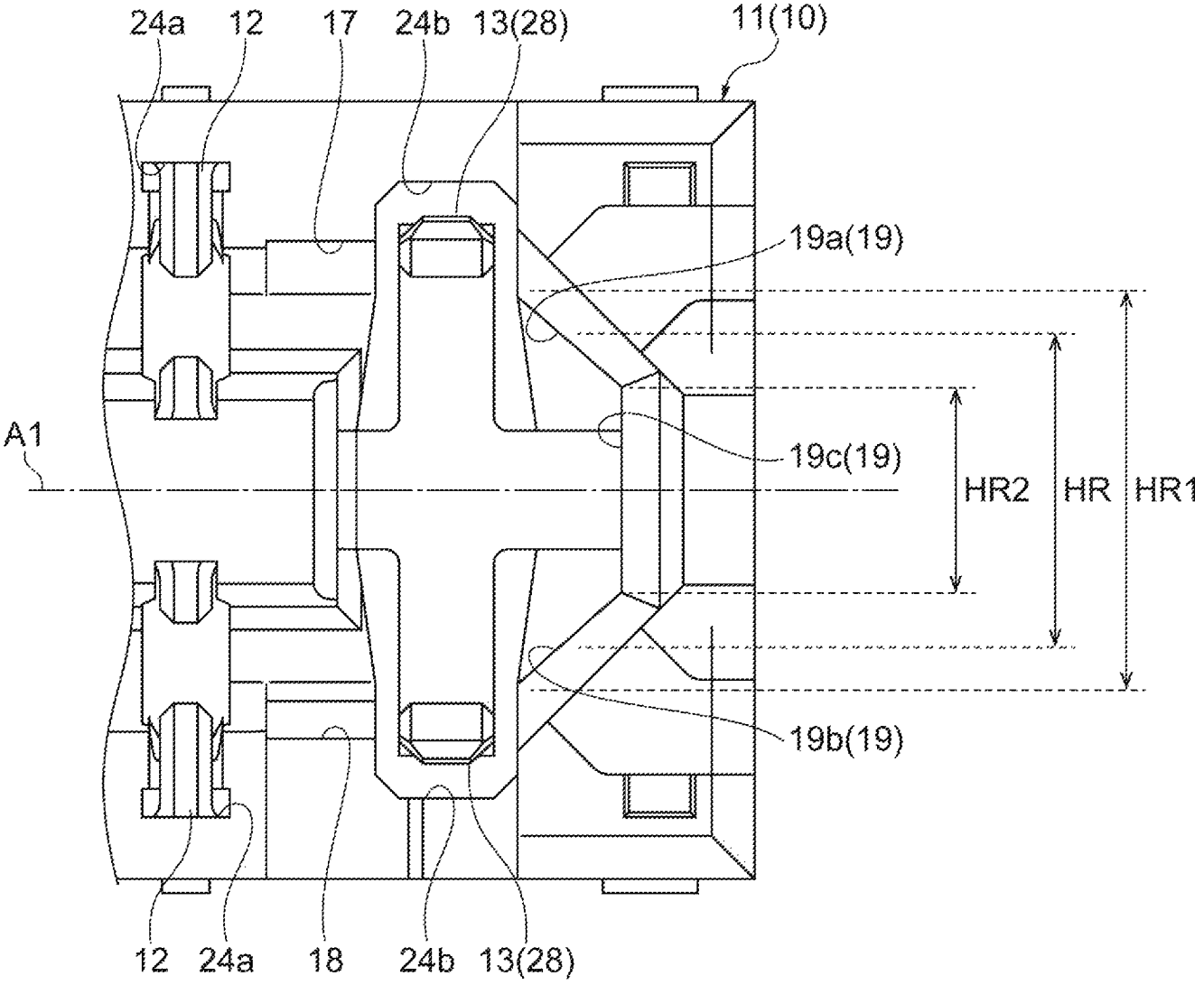
Fig.5
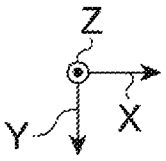

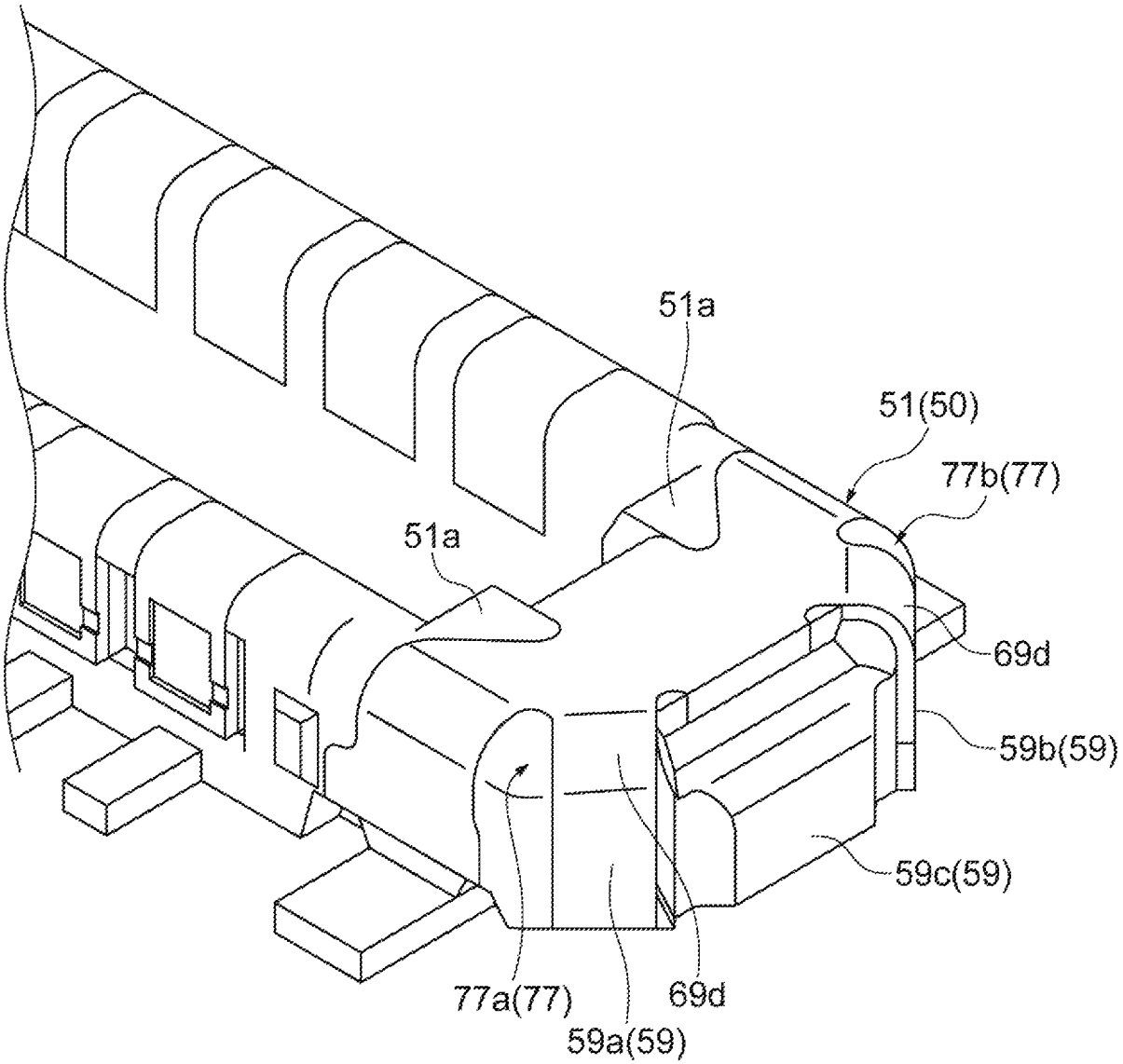
Fig.14
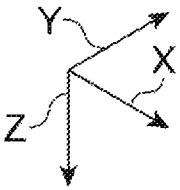

ELECTRIC CONNECTOR AND CONNECTOR DEVICE

CROSS-REFERENCE TO RELATED APPLICATIONS

This application is based upon and claims the benefit of priority from Japanese Patent Application No. 2016474776, filed Sep. 7, 2016, the entire contents of which are incorporated herein by reference.

BACKGROUND

1. Field

The present invention relates to an electric connector and a connector device.

2. Disclosure of the Related Art

In Japanese Unexamined Patent Publication No. 2015-185541, a connector device is disclosed in which printed wiring boards (hereinafter, simply referred to also as "boards") are electrically connected to each other. Such a connection is a so-called board-to-board connection. The connector device includes a plug connector and a receptacle connector. The plug connector mounted in a board is fitted into the receptacle connector mounted in another board. According to such fitting, the boards are electrically connected to each other.

SUMMARY

According to one viewpoint of the present disclosure, there is provided an electric connector configured to be inserted into a counterpart connector arranged in a counterpart main body such that a plurality of counterpart terminals are aligned in a first direction. The electric connector includes: a main body having an insulating property that has a housing portion of a concave shape, which the counterpart connector can be inserted into or extracted from, extending in a second direction; and main body terminals that are electrically connected to the counterpart terminals in a state in which the counterpart connector is inserted into the housing portion. The housing portion includes: one pair of principal wall faces, in which a plurality of the main body terminals are arranged to be aligned in the second direction, extending in the second direction and facing each other; a first-end wall face that connects one principal wall face to the other principal wall face on the side of one end of the one pair of the principal wall faces; and a second-end wall face that connects one principal wall face to the other principal wall face on the side of the other end of the one pair of the principal wall faces. At least parts of the first-end wall face are first guide areas that face each other in a facing direction of the one pair of the principal wall faces and have a gap width forming a narrowing portion in the facing direction decreasing from the second-end wall face toward the first-end wall face in the second direction. The first guide areas guide the counterpart connector such that the first direction of the counterpart connector is lined up in the second direction of the housing portion by regulating movement of the counterpart connector in the facing direction of the principal wall faces when an end portion of the counterpart main body is in contact with the counterpart connector at the time of inserting the counterpart connector into the housing portion.

According to another viewpoint of the present disclosure, there is provided a connector device including a plug connector that is arranged in a plug main body such that a plurality of plug terminals are aligned in a first direction; and a receptacle connector that is configured to be inserted into or extracted from the plug connector. The receptacle connector includes: a main body having an insulating property that has a housing portion of a concave shape, which the plug connector can be inserted into or extracted from, extending in a second direction; and main body terminals that are electrically connected to the plug terminals in a state in which the plug connector is inserted into the housing portion. The housing portion includes: one pair of principal wall faces, in which a plurality of the main body terminals are arranged to be aligned in the second direction, extending in the second direction and facing each other; a first-end wall face that connects one principal wall face to the other principal wall face on the side of one end of the one pair of the principal wall faces; and a second-end wall face that connects one principal wall face to the other principal wall face on the side of the other end of the one pair of the principal wall faces. At least parts of the first-end wall face are first guide areas that face each other in a facing direction of the one pair of the principal wall faces and have a gap width in the facing direction decreasing from the second-end wall face toward the first-end wall face in the second direction. The first guide areas guide the counterpart plug connector such that the first direction of the plug connector is lined up in the second direction of the housing portion by regulating movement of the plug connector in the facing direction of the principal wall faces when an end portion of the plug main body is in contact with the plug connector at the time of inserting the plug connector into the housing portion.

BRIEF DESCRIPTION OF THE DRAWINGS

FIG. 5 is a schematic plan view illustrating an end portion of a receptacle connector in an enlarged scale;

FIG. 14 is a perspective view illustrating a chamfer portion of a plug connector;

DETAILED DESCRIPTION

Figure 1:
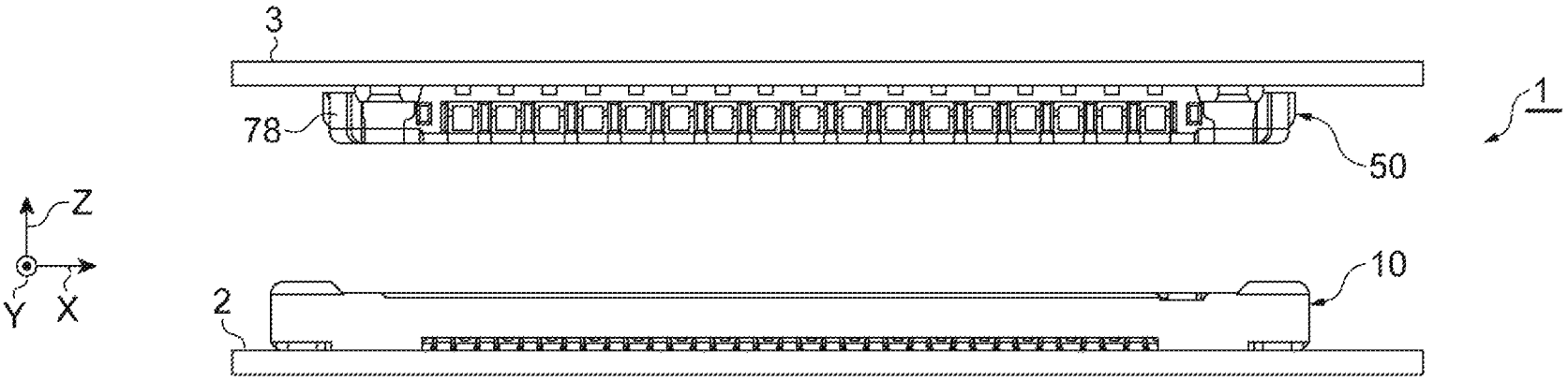
FIG. 1 is a schematic side view illustrating an appearance in which a connector device according to the present disclosure is exploded.

An embodiment according to the present disclosure described below is an example for describing the present invention. Thus, the present invention is not limited to the following contents.

<Overview of Embodiment>

[1] According to one viewpoint of the present disclosure, there is provided an electric connector configured to be inserted into a counterpart connector arranged in a counterpart main body such that a plurality of counterpart terminals are aligned in a first direction. The electric connector includes: a main body having an insulating property that has a housing portion of a concave shape, which the counterpart connector can be inserted into or extracted from, extending in a second direction; and main body terminals that are electrically connected to the counterpart terminals in a state in which the counterpart connector is inserted into the housing portion. The housing portion includes: one pair of principal wall faces, in which a plurality of the main body terminals are arranged to be aligned in the second direction, extending in the second direction and facing each other; a first-end wall face that connects one principal wall face to the other principal wall face on the side of one end of the one pair of the principal wall faces; and a second-end wall face that connects one principal wall face to the other principal wall face on the side of the other end of the one pair of the principal wall faces. At least parts of the first-end wall face are first guide areas that face each other in a facing direction of the one pair of the principal wall faces and have a gap width in the facing direction decreasing from the second-end wall face toward the first-end wall face in the second direction. The first guide areas guide the counterpart connector such that the first direction of the counterpart connector is lined up in the second direction of the housing portion by regulating movement of the counterpart connector in the facing direction of the principal wall faces when an end portion of the counterpart main body is in contact with the counterpart connector at the time of inserting the counterpart connector into the housing portion.

In a state in which the counterpart connector and the electric connector are fitted with each other, the first direction of the counterpart connector is lined up in the second direction of the electric connector. Accordingly, in order to fit the counterpart connector into the electric connector, it is necessary to insert the counterpart connector into the electric connector in a state in which the first direction of the counterpart connector is lined up in the second direction of the electric connector. While the counterpart connector and the electric connector are separate from each other at the beginning, when the end portion of the counterpart main body of the counterpart connector is inserted into the housing portion of the electric connector, the first direction of the counterpart connector may deviate from the second direction of the electric connector. In such a state, the counterpart connector cannot be fitted into the electric connector.

Here, the end portion of the counterpart connector is brought into contact with one of wall faces configuring the housing portion of the electric connector. According to such a contact, the movement of the counterpart connector is regulated. For example, in a case where the counterpart connector is brought into contact with the principal wall face, the movement of the counterpart connector in a direction facing the principal wall face is regulated. In other words, the counterpart connector can move in the second direction. The counterpart connector that can move in the second direction finally arrives at the first-end wall face. Also in the first guide area of the first-end wall face, the movement of the counterpart connector in the direction facing the principal wall face is regulated. In other words, the counterpart connector can move along the first guide area of the first-end wall face. The first guide areas have a gap width in the direction facing the principal wall face gradually decreasing. Thus, when the counterpart connector is moved in the state being in contact with the first guide area, the movement of the counterpart connector is restricted to movement in a direction obliquely intersecting the second direction. The movement in the obliquely intersecting direction has a movement component in a direction orthogonal to the second direction. For this reason, even when the counterpart connector deviates from the electric connector at the beginning, the counterpart connector moves while being in contact with the first guide area. According to such movement, the position of the counterpart connector is corrected such that the first direction of the counterpart connector is gradually lined up in the second direction of the electric connector. In other words, as the counterpart connector moves in the state of being in contact with the first guide area, the position of the counterpart connector is gradually corrected to a position at which fitting can be performed. Then, finally, a state is formed in which the first direction of the counterpart connector is lined up in the second direction of the electric connector. Accordingly, the counterpart connector can be fitted into the electric connector. According to the electric connector of the present disclosure, even in a case where the position of the counterpart connector with respect to the electric connector at the beginning is a position at which fitting cannot be performed, the position of the counterpart connector can be corrected to a position at which fitting can be performed. Accordingly, the electric connector according to the present disclosure can improve the efficiency of an operation of fitting the counterpart connector and the electric connector with each other.

[2] In the electric connector according to the present disclosure, at least a part of the second-end wall face may be second guide areas that face each other in the facing direction of the one pair of the principal wall faces and has a gap width in the facing direction gradually decreasing from the first-end wall face toward the second-end wall face in the second direction. The second guide areas may guide the counterpart connector such that the first direction of the counterpart connector is lined up in the second direction of the housing portion by regulating movement of the counterpart connector in the facing direction of the principal wall faces when an end portion of the counterpart main body is in contact with the counterpart connector at the time of inserting the counterpart connector into the housing portion.

According to such a configuration, in a case where the counterpart connector that is brought into contact with the principal wall face is moved to the side of one end portion of the housing portion, the position of the counterpart connector with respect to the electric connector is corrected to a position at which fitting can be performed. Accordingly, the efficiency of the operation of fitting the counterpart connector and the electric connector with each other can be improved.

[3] In the electric connector according to the present disclosure, the first-end wall face and the second-end wall face may exhibit planar shapes. According to such a configuration, the movement amount of the counterpart connector in the facing direction with respect to the movement amount in the second direction can be a desired constant value.

[4] In the electric connector according to the present disclosure, the first-end wall face and the second-end wall face may exhibit curved shapes. According to such a configuration, the inclinations of the first guide area and the second guide area with respect to the second direction changes according to a position within the areas. Accordingly, the ratio of the movement amount of the counterpart connector in the facing direction to the movement amount in the second direction can be changed.

[5] In the electric connector according to the present disclosure, the first guide areas and the second guide areas may include portions formed using metal materials. According to such a configuration, the surface strength of the first guide area and the second guide area can be improved. Accordingly, the counterpart connector that is brought into contact with the first guide area and the second guide area can be moved with being rubbed with the first guide area and the second guide area.

[6] In the electric connector according to the present disclosure, the first guide areas and the second guide areas may include the portions formed using the metal materials in portions facing the first-end wall face and portions facing the second-end wall face. According to such a configuration, the surface strength of each of the portions facing the first-end wall face can be improved. In addition, the surface strength of each of the portions facing the second-end wall face can be improved.

[7] In the electric connector according to the present disclosure, the housing portion may include an opening receiving the counterpart connector. The opening may be formed by end edges of the one pair of the principal wall faces, an end edge of the first-end wall face, and an end edge of the second-end wall face. The main body may include at least one of a first chamfer continuous to the end edge of the first guide area included in the end edge of the first-end wall face and a second chamfer continuous to the end edge of the second guide area included in the end edge of the second-end wall face.

When the counterpart connector and the electric connector are in a plan view, there may be cases where the counterpart connector deviates from the electric connector. According to such a deviation, there may be cases where a physical interference between the electric connector and the counterpart connector occurs. In such cases, the counterpart connector cannot be inserted into the housing portion of the electric connector. The counterpart connector is moved in a state in which the counterpart connector is in contact with the first chamfer and the second chamfer. Then, the counterpart connector moves along the surfaces of the first chamfer and the second chamfer. Then, finally, the counterpart connector arrives at the first guide area and the second guide area that are continuous to the first chamfer and the second chamfer. After the counterpart connector arrives at the first guide area and the second guide area, the counterpart connector can be moved to the housing portion along the first guide area and the second guide area. Thus, according to the electric connector according to the present disclosure, even when the positions of the counterpart connector and the electric connector at the beginning are positions at which fitting cannot be performed, the position of the counterpart connector with respect to the electric connector can be corrected to a position at which fitting can be performed. Accordingly, the electric connector according to the present disclosure can improve the efficiency of the operation of fitting the counterpart connector and the electric connector with each other.

[8] In the electric connector according to the present disclosure, the first chamfer and the second chamfer may include portions formed using metal materials. According to such a configuration, the surface strength of the first chamfer and the second chamfer can be improved. Accordingly, the counterpart connector that is brought into contact with the first chamfer can be moved with being rubbed with the first chamfer. In addition, the counterpart connector that is brought into contact with the second chamfer can be moved with being rubbed with the second chamfer.

[9] A connector device according to another viewpoint of the present disclosure includes: a plug connector that is arranged in a plug main body such that a plurality of plug terminals are aligned in a first direction; and a receptacle connector that is configured to be inserted into or extracted from the plug connector. The receptacle connector includes: a main body having an insulating property that has a housing portion of a concave shape, which the plug connector can be inserted into or extracted from, extending in a second direction; and main body terminals that are electrically connected to the plug terminals in a state in which the plug connector is inserted into the housing portion. The housing portion includes: one pair of principal wall faces, in which a plurality of the main body terminals are arranged to be aligned in the second direction, extending in the second direction and facing each other; a first-end wall face that connects one principal wall face to the other principal wall face on the side of one end of the one pair of the principal wall faces; and a second-end wall face that connects one principal wall face to the other principal wall face on the side of the other end of the one pair of the principal wall faces. At least parts of the first-end wall face are first guide areas that face each other in a facing direction of the one pair of the principal wall faces and have a gap width in the facing direction decreasing from the second-end wall face toward the first-end wall face in the second direction. The first guide areas may guide the counterpart plug connector such that the first direction of the plug connector is lined up in the second direction of the housing portion by regulating movement of the plug connector in the facing direction of the principal wall faces when an end portion of the plug main body is in contact with the plug connector at the time of inserting the plug connector into the housing portion.

The receptacle connector of the connector device includes the first guide areas. Accordingly, even when the position of the plug connector with respect to the receptacle connector at the beginning is a position at which fitting cannot be performed, the position of the plug connector can be corrected to a position at which fitting can be performed. Accordingly, the electric connector according to the present disclosure can improve the efficiency of an operation of fitting the plug connector and the receptacle connector with each other.

According to the electric connector and the connector device of the present disclosure, the efficiency of the operation of fitting the plug connector and the receptacle connector with each other can be improved.

<Exemplary Embodiments>

Hereinafter, one example of an embodiment according to the present disclosure will be described in more details with reference to the drawings. A same reference numeral will be used for the same element or elements having the same function, and duplicate description thereof will not be presented.

As illustrated in FIG. 1, a connector device 1 according to the present disclosure includes a receptacle connector 10 (electrical connector) and a plug connector 50 (counterpart connector). The receptacle connector 10 is mounted on one printed wiring board 2. The plug connector 50 is mounted on the other printed wiring board 3. The connector device 1 electrically connects the printed wiring boards 2 and 3 as the plug connector 50 fits into the receptacle connector 10.

In description presented below, for the convenience of description, various directions will be represented by the XYZ coordinate system. An X-axis direction and a Y-axis direction are included in a virtual plane that is parallel to the printed wiring boards 2 and 3. The X-axis direction coincides with a longitudinal direction of the receptacle connector 10 and the plug connector 50. The longitudinal direction is the horizontal direction in FIG. 1. A Y-axis direction coincides with the transverse direction of the receptacle connector 10 and the plug connector 50. The transverse direction is a direction perpendicular to the paper surface in FIG. 1. A Z-axis direction coincides with the direction of a normal line of the printed wiring boards 2 and 3. The direction of the normal line is the vertical direction in FIG. 1. In other words, the Z-axis direction coincides with a direction in which the receptacle connector 10 and the plug connector 50 face each other.

[Receptacle Connector]

Figure 2:
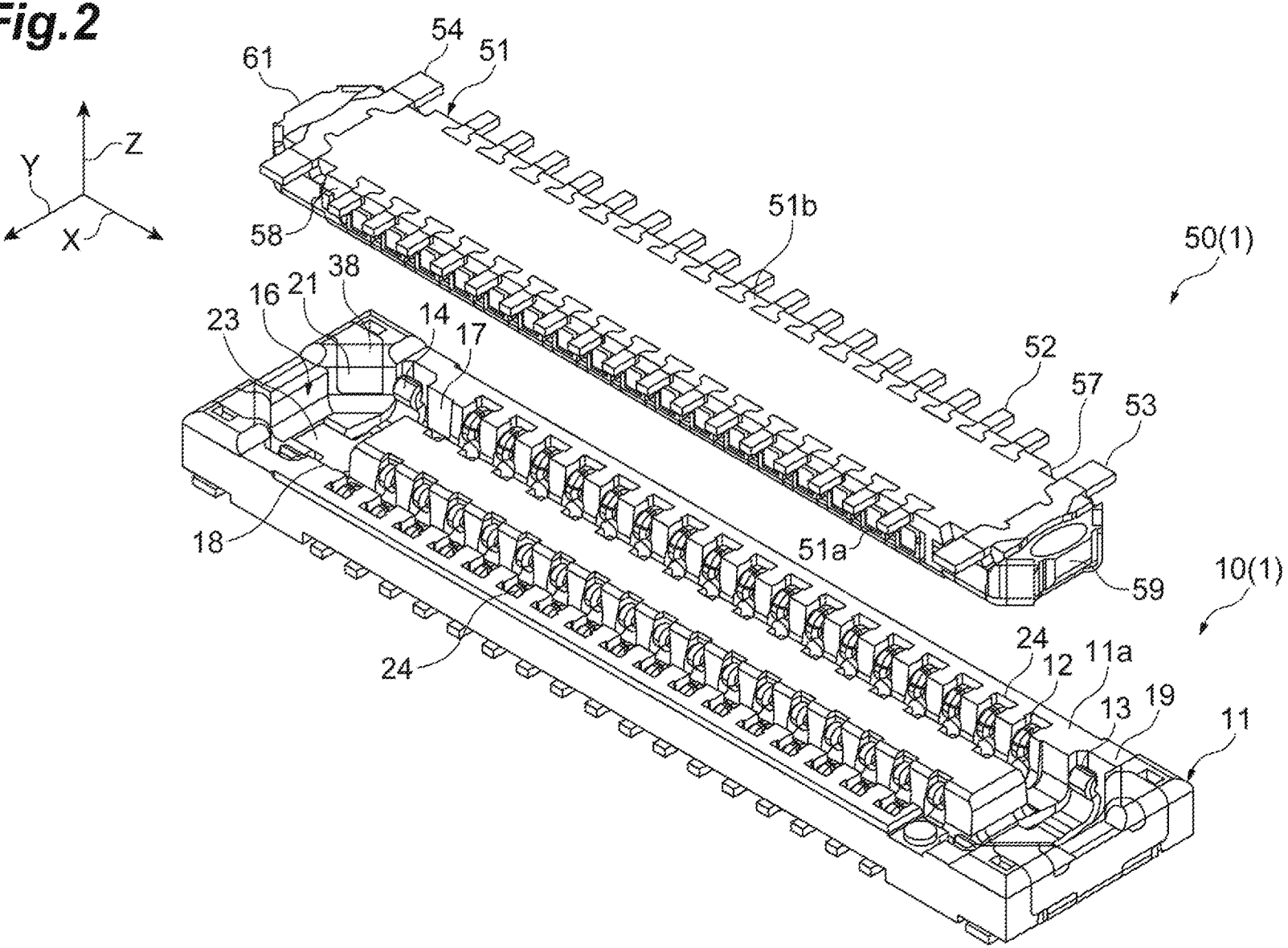
FIG. 2 is a perspective view illustrating an appearance in which the connector device according to the present disclosure is exploded.

The receptacle connector 10 will be described. As illustrated in FIG. 2, the receptacle connector 10 is configured to be inserted into or extracted from the plug connector 50. The receptacle connector 10 includes a receptacle housing 11 (main body), a plurality of receptacle terminals 12 (main body terminals), a first receptacle fixing metal fitting 13 (first fixing metal fitting) and a second receptacle fixing metal fitting 14 (second fixing metal fitting) as its major constituent elements.

The receptacle housing 11 is a base of the receptacle connector 10. The receptacle housing 11 is formed using a material having an electric insulation property. The receptacle housing 11 exhibits an approximate rectangular parallelepiped shape extending in the X-axis direction (the longitudinal direction, a second direction). The receptacle housing 11 has the Z-axis direction as its normal-line direction. The receptacle housing 11 has a principal face 11*a* facing the plug connector 50.

In the receptacle housing 11, a housing portion 16 is disposed. The housing portion 16 exhibits a concave shape housing the plug connector 50. The housing portion 16 is a recessed portion with respect to the principal face 11*a*. The housing portion 16 is a space surrounded by a first principal inner wall face 17, a second principal inner wall face 18, a first-end inner wall face 19 (first-end wall face), a second-end inner wall face 21 (second-end wall face), and a bottom face 23. The first principal inner wall face 17 is one of one pair of principal wall faces. The second principal inner wall face 18 is the other of one pair of principal wall face. The first principal inner wall face 17 and the second principal inner wall face 18 extend in the X-axis direction. The first principal inner wall face 17 faces the second principal inner wall face 18 in the Y-axis direction. The first-end inner wall face 19 is formed on the side of one end of the receptacle housing 11 in the X-axis direction. One end of the first principal inner wall face 17 is connected to one end of the second principal inner wall face 18. The first-end inner wall face 19 includes a plurality of faces having mutually-different normal line directions. The second-end inner wall face 21 is formed on the side of the other end of the receptacle housing 11 in the X-axis direction. The second-end inner wall face 21 connects the other end of the first principal inner wall face 17 to the other end of the second principal inner wall face 18. The second-end inner wall face 21, similar to the first-end inner wall face 19, includes a plurality of faces having mutually-different normal line directions.

The receptacle terminals 12 are conductive parts. The receptacle terminals 12 electrically connect the printed wiring boards 2 and 3. The receptacle terminals 12 are integrally formed using a material having conductivity. Some of the receptacle terminals 12 are electrically connected to electrode pads (not illustrated in the drawing) of the printed wiring board 2 by using solder or the like. Other some of the receptacle terminals 12 are electrically connectable to a plurality of plug terminals 52 (a plurality of counterpart terminals) to be described later. The plurality of receptacle terminals 12 are arranged in the receptacle housing 11 to align in the X-axis direction. Thus, the X-axis line direction is a terminal arrangement direction. In more detail, the receptacle housing 11 includes a plurality of concave portions 24. The plurality of concave portions 24 are recessed with respect to the first principal inner wall face 17 in the Y-axis direction. The receptacle terminal 12 is arranged in each of the plurality of concave portions 24. The receptacle housing 11 further includes a plurality of concave portions 24. The plurality of concave portions 24 are recessed with respect to the second principal inner wall face 18 in the Y-axis direction. Also in each of the plurality of concave portions 24, the receptacle terminal 12 is arranged.

The first receptacle fixing metal fitting 13 is arranged on the side of one end of the receptacle housing 11 in the X-axis direction. On the other hand, the second receptacle fixing metal fitting 14 is arranged on the side of the other end of the receptacle housing 11 in the X-axis direction. In other words, the first receptacle fixing metal fitting 13 and the second receptacle fixing metal fitting 14 are arranged to have the plurality of the receptacle terminals 12 interposed therebetween in the X-axis direction. The first receptacle fixing metal fitting 13 and the second receptacle fixing metal fitting 14 physically connects the receptacle housing 11 to the printed wiring board 2. In addition, the first receptacle fixing metal fitting 13 and the second receptacle fixing metal fitting 14 has the plug connector 50 inserted into the housing portion 16 interposed therebetween. Furthermore, the first receptacle fixing metal fitting 13 and the second receptacle fixing metal fitting 14 may be electrically connected to the plug connector 50 for conduction with the plug connector 50.

Figure 3:
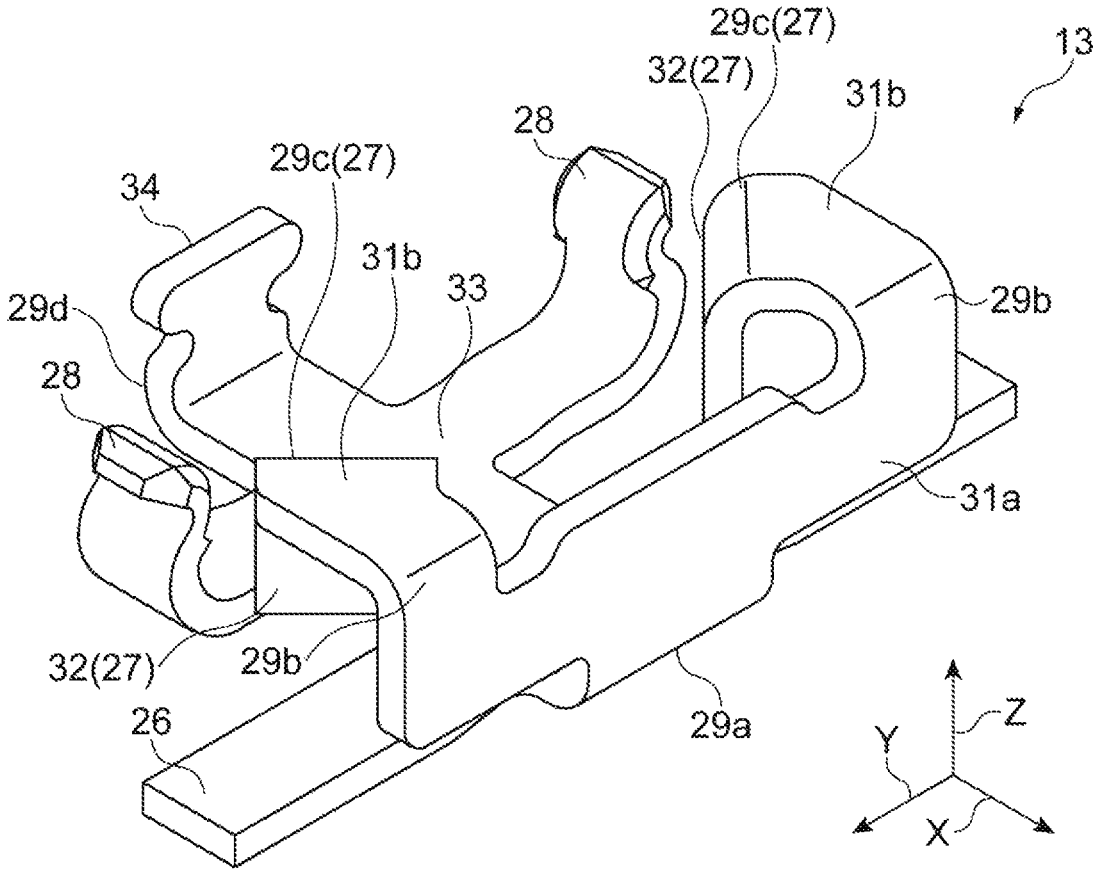
FIG. 3 is a perspective view illustrating a first fixing metal fitting.

The first receptacle fixing metal fitting 13 will be described in detail with reference to FIG. 3. The second receptacle fixing metal fitting 14 is different from the first receptacle fixing metal fitting 13 only in the arranged position. As a single body, the second receptacle fixing metal fitting 14 has the same configuration as that of the first receptacle fixing metal fitting 13. Thus, detailed description of the second receptacle fixing metal fitting 14 will not be presented.

The first receptacle fixing metal fitting 13 includes a board fixing portion 26, a guide portion 27, a holding portion 28, and a metal fitting main body 33 as its main constituent elements. The board fixing portion 26, the guide portion 27, the holding portion 28, and the metal fitting main body 33 are integrated through a plurality of bending portions 29*a*, 29*b*, 29*c*, and 29*d* and connection portions 31*a* and 31*b*.

The board fixing portion 26 is a plate-shaped portion. The board fixing portion 26 is physically fixed to a wiring pattern of the printed wiring board 2 by using solder or the like. The board fixing portion 26 extends in the Y-axis direction when arranged in the receptacle housing 11. The connection portion 31*a* rises through the bending portion 29*a* in the Z-axis direction in an approximately center portion of the board fixing portion 26 in the Y-axis direction. At both ends of the connection portion 31*a* in the Y-axis direction, the bending portions 29*b* are disposed. In addition, one pair of the connection portions 31*b* extending in the X-axis direction are connected to both ends of the connection portion 31*a*. The guide portion 27 extending in the Z-axis direction is connected to one end of each connection portion 31*b*. The guide portion 27 includes a bending portion 29*c* and a flat plate portion 32. One end of the bending portion 29*c* is continuous to the connection portion 31*b*. The other end of the bending portion 29*c* is continuous to the flat plate portion 32. The flat plate portion 32 extends from the bending portion 29*c* in the Z-axis direction. A front end of the flat plate portion 32 is a free end. The guide portion 27 is exposed from the receptacle housing 11. The guide portion 27 configures a part of the first-end inner wall face 19.

The metal fitting main body 33 extends in the X-axis direction at an approximately center portion of the board fixing portion 26 in the Y-axis direction. At the front end of the metal fitting main body 33, a rising portion 34 is formed. The rising portion 34 extends in the Z-axis direction through the bending portion 29*d*. One pair of holding portions 28 is formed in the metal fitting main body 33. One pair of the holding portions 28 is formed between one end continuous to the board fixing portion 26 and the other end continuous to the rising portion 34. The holding portion 28 exhibits a curved face shape extending in the Y-axis direction and the Z-axis direction. The holding portion 28 is not physically fixed to the receptacle housing 11. The holding portion 28 has elasticity in the Y-axis direction.

[Plug Connector]

The plug connector 50 will be described with reference back to FIG. 2. The plug connector 50 is configured to be able to be inserted into or extracted from the receptacle connector 10. The plug connector 50 includes a plug housing 51 (counterpart main body), a plurality of plug terminals 52, a first plug fixing metal fitting 53, and a second plug fixing metal fitting 54 as its main constituent elements.

The plug housing 51 is a base of the plug connector 50. The plug housing 51 is formed using a material having electric insulation. The plug housing 51 exhibits an approximate parallel piped shape extending in the X-axis direction (the longitudinal direction, a first direction). The plug housing 51 includes a first principal outer wall face 57, a second principal outer wall face 58, a first-end outer wall face 59, a second-end outer wall face 61, a principal face 51*a*, and a board face 51*b*.

The first principal outer wall face 57 and the second principal outer wall face 58 extend in the X-axis direction. The first principal outer wall face 57 and the second principal outer wall face 58 face each other in the Y-axis direction. The first-end outer wall face 59 is formed on the side of one end of the plug housing 51. The first-end outer wall face 59 connects one end of the first principal outer wall face 57 to one end of the second principal outer wall face 58. The first-end outer wall face 59 includes a plurality of faces having mutually-different normal line directions. The second-end outer wall face 61 is formed on the side of the other end of the plug housing 51. The second-end outer wall face 61 connects the other end of the first principal outer wall face 57 to the other end of the second principal outer wall face 58. The second-end outer wall face 61, similar to the first-end outer wall face 59, includes a plurality of faces having mutually-different normal line directions.

The plug terminals 52 are conductive parts. The plug terminals 52 secure electrical connections between the printed wiring boards 2 and 3. The plug terminals 52 are integrally formed using a material having conductivity. Some of the plug terminals 52 are electrically connected to electrode pads (not illustrated in the drawing) of the printed wiring board 3 by using solder or the like. In addition, other some of the plug terminals 52 are configured to be electrically connectable to the receptacle terminals 12 of the receptacle connector 10. The plurality of the plug terminals 52 are arranged in the plug housing 51 to be aligned in the X-axis direction.

The first plug fixing metal fitting 53 is arranged on the side of one end of the plug housing 51 in the X-axis direction. On the other hand, the second plug fixing metal fitting 54 is arranged on the side of the other end of the plug housing 51 in the X-axis direction. In other words, the first plug fixing metal fitting 53 and the second plug fixing metal fitting 54 are arranged to have the plurality of the plug terminals 52 interposed therebetween in the X-axis direction.

The first plug fixing metal fitting 53 and the second plug fixing metal fitting 54 physically fixes the plug housing 51 to the printed wiring board 3. In addition, when inserted into the housing portion 16, the first plug fixing metal fitting 53 and the second plug fixing metal fitting 54 are interposed between the first receptacle fixing metal fitting 13 and the second receptacle fixing metal fitting 14 of the receptacle connector 10 In addition, the first plug fixing metal fitting 53 may be electrically connected to the first receptacle fixing metal fitting 13 of the receptacle connector 10 for conduction with the receptacle connector 10. In addition, the second plug fixing metal fitting 54 may be electrically connected to the second receptacle fixing metal fitting 14 of the receptacle connector 10.

Figure 4:
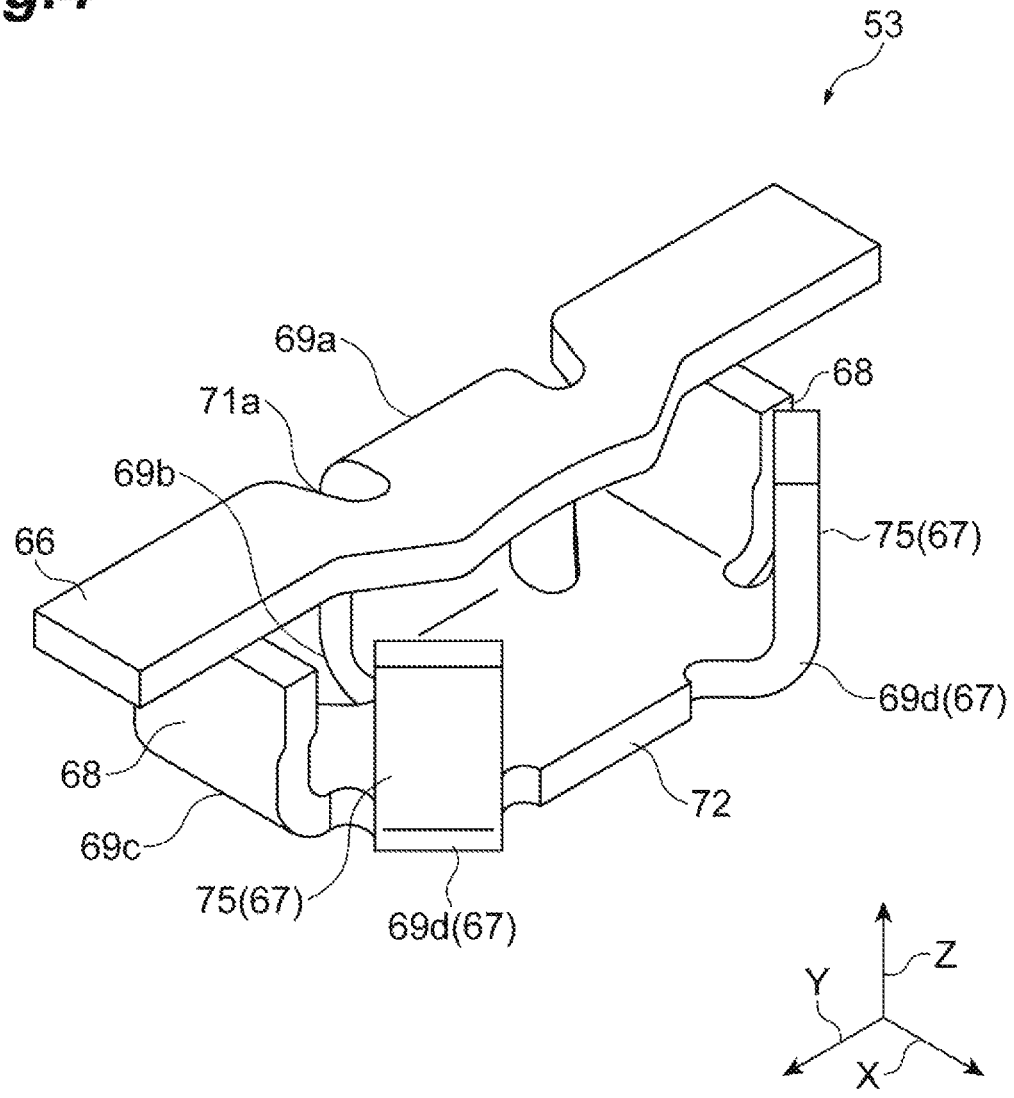
FIG. 4 is a perspective view illustrating a first plug fixing metal fitting.

The first plug fixing metal fitting 53 will be described in detail with reference to FIG. 4. The second plug fixing metal fitting 54 is different from the first plug fixing metal fitting 53 only in the arranged position. The second plug fixing metal fitting 54 has the same configuration as that of the first plug fixing metal fitting 53. Thus, detailed description of the second plug fixing metal fitting 54 will not be presented.

The first plug fixing metal fitting 53 includes a board fixing portion 66, a guide portion 67, and holding target portions 68 as its major constituent elements. The board fixing portion 66, the guide portion 67, and the holding target portions 68 are integrated with a plurality of bending portions 69*a*, 69*b*, 69*c*, and 69*d* through a connection portion 71*a*. The board fixing portion 66 is a plate-shaped portion. The board fixing portion 66 is physically fixed to the wiring pattern of the printed wiring board 3 by using solder or the like. The board fixing portion 66 extends in the Y-axis direction. One end of the connection portion 71*a* is connected to an approximately center portion of the board fixing portion 66 in the Y-axis direction through the bending portion 69*a*. The metal fitting main body 72 is connected to the other end of the connection portion 71*a* through the bending portion 69*b*. The bending portions 69*c* are disposed in side portions of the metal fitting main body 72 in the Y-axis direction. In addition, one pair of the holding target portions 68 extending in the Z-axis direction are connected to the side portions of the metal fitting main body 72. The holding target portions 68 rises in the Z-axis direction. The holding target portions 68 configure parts of the first principal outer wall face 57 and the second principal outer wall face 58 of the plug housing 51. When the plug connector 50 is fitted into the receptacle connector 10, the holding target portions 68 are sandwiched by the holding portions 28 of the first receptacle fixing metal fitting 13.

The guide portion 67 is further continuous to the metal fitting main body 72. The guide portion 67 includes a bending portion 69*d* and a flat plate portion 75. One end of the bending portion 69*d* is continuous to the metal fitting main body 72. The other end of the bending portion 69*d* is continuous to the flat plate portion 75. The flat plate portion 75 extends from the bending portion 69*d* in the Z-axis direction. A front end of the flat plate portion 75 is a free end. The guide portion 67 is exposed from the plug housing 51. The guide portion 67 configures a part of the first-end outer wall face 59.

A detailed configuration of the side of one end of the receptacle connector 10 will be described more specifically with reference to FIG. 5. A detailed configuration of the side of the other end of the receptacle connector 10 is similar to that of the side of the one end. Thus, description of the side of the other side of the receptacle connector 10 will not be presented. More specifically, detailed description of a second receptacle guide face (second guide area) will not be presented. The second receptacle guide face is included in the second-end inner wall face 21 disposed on the side of the other end of the receptacle connector 10.

As illustrated in FIG. 5, the side of one end of the receptacle connector 10 includes the side of one end of the first principal inner wall face 17, the side of one end of the second principal inner wall face 18, and the first-end inner wall face 19. The first principal inner wall face 17 and the second principal inner wall face 18 are uneven faces formed by a plurality of flat faces. The receptacle terminal 12 is arranged in a concave portion 24*a*. The holding portion 28 of the first receptacle fixing metal fitting 13 is arranged in a concave portion 24*b*. The first-end inner wall face 19 includes first receptacle guide faces 19*a* and 19*b* (first guide areas) and a receptacle tip end face 19*c*. One end of the first receptacle guide face 19*a* is connected to one end of the first principal inner wall face 17. One end of the first receptacle guide face 19*b* is connected to one end of the second principal inner wall face 18. One end of the receptacle tip end face 19*c* is connected to the other end of the first receptacle guide face 19*a*. The other end of the receptacle tip end face 19*c* is connected to the other end of the first receptacle guide face 19*b*. In other words, the first-end inner wall face 19 is formed in order of the first receptacle guide face 19*a*, the receptacle tip end face 19*c*, and the first receptacle guide face 19*b* between one end of the first principal inner wall face 17 and one end of the second principal inner wall face 18.

The first receptacle guide face 19*a* faces the first receptacle guide face 19*b* in the Y-axis direction. In other words, one pair of the first receptacle guide faces 19*a* and 19*b* have line symmetry with respect to an axial line A1 of the receptacle housing 11 disposed along the X-axis direction. A gap width HR gradually decreases toward the receptacle tip end face 19*c*. The gap width HR is a length from the first receptacle guide face 19*a* to the first receptacle guide face 19*b* in the Y-axis direction. A second gap width HR2 is smaller than a first gap width HR1. The second gap width HR2 is a length from the other end of the first receptacle guide face 19*a* to the other end of the first receptacle guide face 19*b*. The first gap width HR1 is a length from one end of the first receptacle guide face 19*a* to one end of the first receptacle guide face 19*b*. For example, a relation between the first gap width HR1 and the second gap width HR2 is represented by a ratio. When the first gap width HR1 is "1", for example, the second gap width HR2 is "0.6".

Such a structure is due to the inclination of one pair of the first receptacle guide faces 19*a* and 19*b* with respect to the X-axis direction. An angle between the first receptacle guide face 19*a* and the X axis is, for example, 45 degrees. An angle between the first receptacle guide face 19*b* and the X axis is, for example, 45 degrees. In other words, the first receptacle guide face 19*a* is inclined with respect to the first principal inner wall face 17. In addition, the first receptacle guide face 19*b* is inclined with respect to the second principal inner wall face 18.

Figure 6:
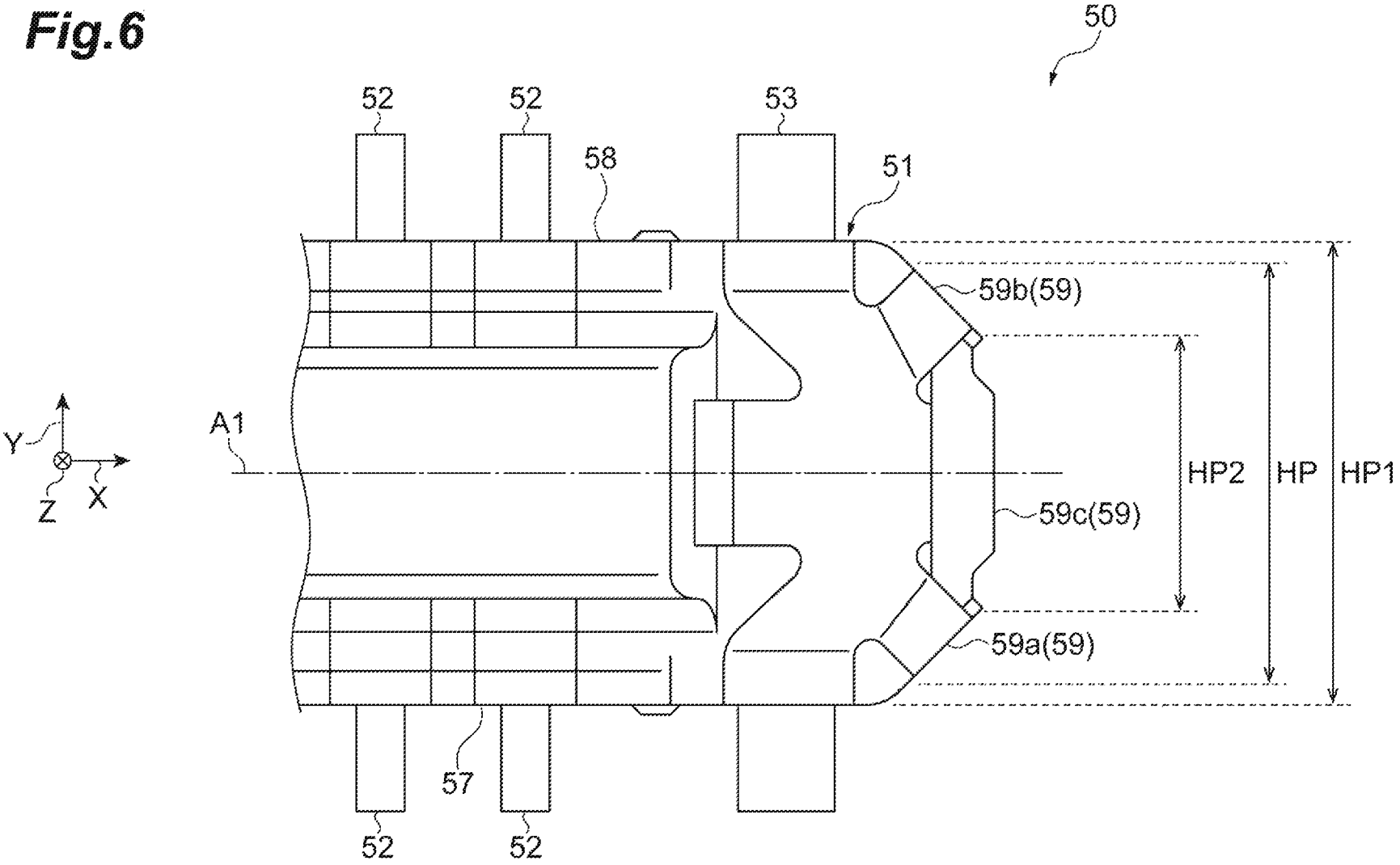
FIG. 6 is a schematic plan view illustrating an end portion of a plug connector in an enlarged scale.

A detailed configuration of the side of one end of the plug connector 50 will be described with reference to FIG. 6. A detailed configuration of the side of the other end of the plug connector 50 is similar to the configuration of the side of the one end. Thus, description of the side of the other end of the plug connector 50 will not be presented. As illustrated in FIG. 6, the side of one end of the plug connector 50 includes the side of one end of the first principal outer wall face 57, the side of one end of the second principal outer wall face 58, and the first-end outer wall face 59. The first principal outer wall face 57 and the second principal outer wall face 58 are one pair of flat faces facing each other in the Y-axis direction. The first principal outer wall face 57 and the second principal outer wall face 58 are side wall faces of the plug housing 51. The plug terminal 52 is embedded in the plug housing 51. A part of the plug terminal 52 is exposed from the plug housing 51. The plug terminal 52 configures parts of the first principal outer wall face 57 and the second principal outer wall face 58. In addition, the first plug fixing metal fitting 53 is embedded in the plug housing 51. A part of the first plug fixing metal fitting 53 is exposed from the plug housing 51. A part of the first plug fixing metal fitting 53 configures parts of the first principal outer wall face 57 and the second principal outer wall face 58. In other words, the first principal outer wall face 57 and the second principal outer wall face 58 are configured by the plug housing 51, the plug terminal 52, and the first plug fixing metal fitting 53.

The first-end outer wall face 59 includes a first plug guide face 59*a*, a first plug guide face 59*b*, and a plug tip end face 59*c*. One end of the first plug guide face 59*a* is connected to one end of the first principal outer wall face 57. One end of the first plug guide face 59*b* is connected to one end of the second principal outer wall face 58. One end of the plug tip end face 59*c* is connected to the other end of the first plug guide face 59*a*. The other end of the plug tip end face 59*c* is connected to the other end of the first plug guide face 59*b*.

In other words, the first-end outer wall face 59 is formed in order of the first plug guide face 59*a*, the plug tip end face 59*c*, and the first plug guide face 59*b* between one end of the first principal outer wall face 57 and one end of the second principal outer wall face 58.

The first plug guide face 59*a* faces the first plug guide face 59*b* in the Y-axis direction. In other words, the first plug guide face 59*a* and the first plug guide face 59*b* have line symmetry with respect to an axial line A2 of the plug housing 51 disposed in the X-axis direction. A housing width HP gradually decreases toward the plug tip end face 59*c*. The housing width HP is a length from the first plug guide face 59*a* to the first plug guide face 59*b* in the Y-axis direction. A second housing width HP2 is smaller than a first housing width HP1. The second housing width HP2 is a length from the other end of the first plug guide face 59*a* to the other end of the first plug guide face 59*b*. The first housing width HP1 is a length from one end of the first plug guide face 59*a* to one end of the first plug guide face 59*b*. This second housing width HP2 is larger than the first gap width HR1 of the receptacle connector 10. Accordingly, the plug tip end face 59*c* of the plug connector 50 is not in contact with the receptacle tip end face 19*c* of the receptacle connector 10. In a state in which the plug connector 50 is fitted into the receptacle connector 10, a gap is formed between the receptacle tip end face 19*c* and the plug tip end face 59*c*.

For example, when a relation between the first housing width HP1 and the second housing width HP2 is represented by a ratio, when the first housing width HP1 is "1", for example, the second housing width HP2 is "0.6". Such a structure is due to the inclination of the first plug guide face 59*a* and the first plug guide face 59*b* with respect to the X-axis direction. For example, an angle between the first plug guide face 59*a* and the X axis is 45 degrees. An angle between the first plug guide face 59*b* and the X axis is, for example, 45 degrees. In other words, the first plug guide face 59*a* is inclined with respect to the first principal outer wall face 57. In addition, the first plug guide face 59*a* is inclined with respect to the second principal outer wall face 58.

Here, a guide function achieved by the receptacle connector 10 will be described. The guide function is achieved when the plug connector 50 is inserted into the receptacle connector 10. The guide function represents a function of correcting the posture of the plug connector 50 to a posture that can be fitted into the receptacle connector 10. The "posture" described here represents a three-dimensional position having three-dimensional coordinates of the plug connector 50 with respect to the receptacle connector 10 as the reference or an inclination using axial lines of three dimensional coordinates as the reference. When the plug connector 50 is physically fitted into the receptacle connector 10, the posture of the plug connector with respect to the receptacle connector 10 is unique. Accordingly, when the receptacle connector 10 is fitted into the plug connector 50, it is preferable to insert the plug connector 50 after matching the posture of the plug connector 50 with respect to the receptacle connector 10 to a posture that can be fitted. However, in an actual assembly operation, when the plug connector 50 is inserted after matching the posture of the plug connector 50 to a posture that can be fitted, it takes a time. Thus, in a case where the receptacle connector 10 or the plug connector 50 has a function for correcting the posture of the plug connector 50 to a fitting posture, the posture of the plug connector 50 is corrected during an insertion operation although the posture of the plug connector 50 is not matched to a posture that can be fitted at the time of starting the insertion operation. Then, finally, the plug connector 50 can be fitted into the receptacle connector 10.

<First Guide Function>

Figure 7A:
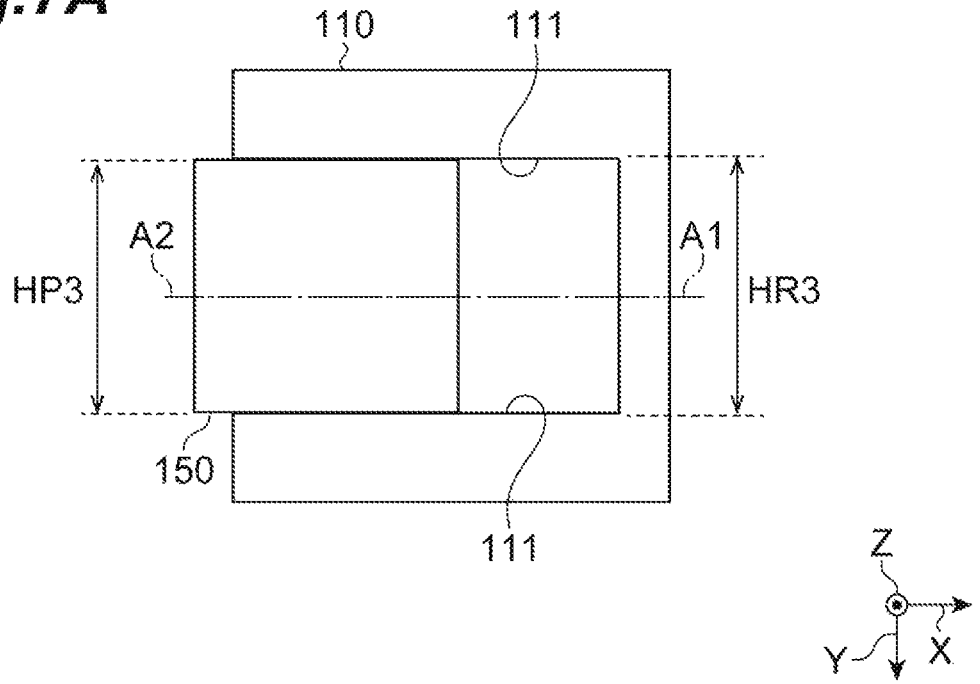
FIG. 7A is a schematic plan view of an end portion of a connector device according to a comparative example.
Figure 7B:
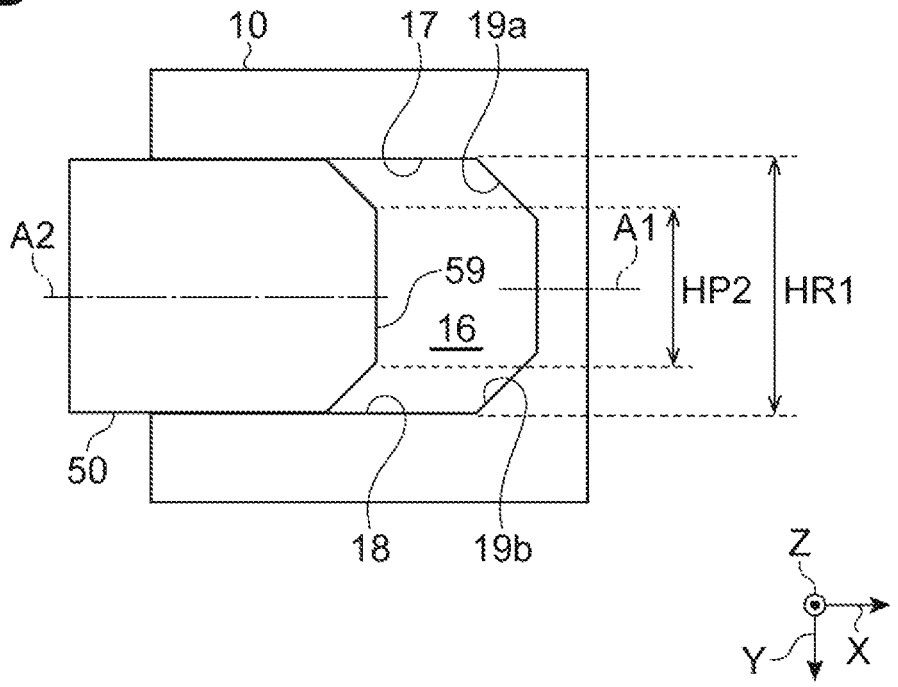
FIG. 7B is a schematic plan view illustrating an end portion of a connector device for describing a guide function achieved by a connector device according to the present disclosure.

FIG. 7A is a diagram that illustrates a receptacle connector 110 according to a comparative example. The receptacle connector 110 according to the comparative example includes one pair of principal inner wall faces 111. A gap width HR3 of the principal inner wall faces 111 is the same as a housing width HP3 of a plug connector 150. FIG. 7B is a diagram that illustrates a first guide function. The first guide function is one of guide functions achieved by the receptacle connector 10 according to the present disclosure. FIGS. 7A and 7B illustrate receptacle connectors 10 and 110 and plug connectors 50 and 150 in a simplified manner. FIGS. 7A and 7B illustrate only constituent elements that are necessary for describing the first guide function.

As illustrated in FIG. 7A, in the case of the receptacle connector 110 according to the comparative example, unless an axial line A2 of the plug connector 150 and an axial line A1 of the receptacle connector 10 are matched to each other, the plug connector 150 cannot be inserted into the receptacle connector 110. In other words, the receptacle connector 110 according to the comparative example cannot achieve the function of correcting the posture of the plug connector 150. Accordingly, the receptacle connector 110 does not have a guide function.

On the other hand, as illustrated in FIG. 7B, in the receptacle connector 10 according to the present disclosure, a reception portion represented by the first gap width HR1 is larger than a tip end width of the plug tip end face 59*c* of the plug connector 50. The reception portion is between one end of one first receptacle guide face 19*a* and one end of the other first receptacle guide face 19*b*. The tip end width has the same meaning as the second housing width HP2. Accordingly, when the plug connector 50 is inserted into the receptacle connector 10, the receptacle connector 10 can allow a deviation of the axial line A2 of the plug connector 50 with respect to the axial line A1 of the receptacle connector 10. The amount of the allowable deviation is the same as a difference between the first gap width HR1 and the second housing width HP2.

Figure 8A:
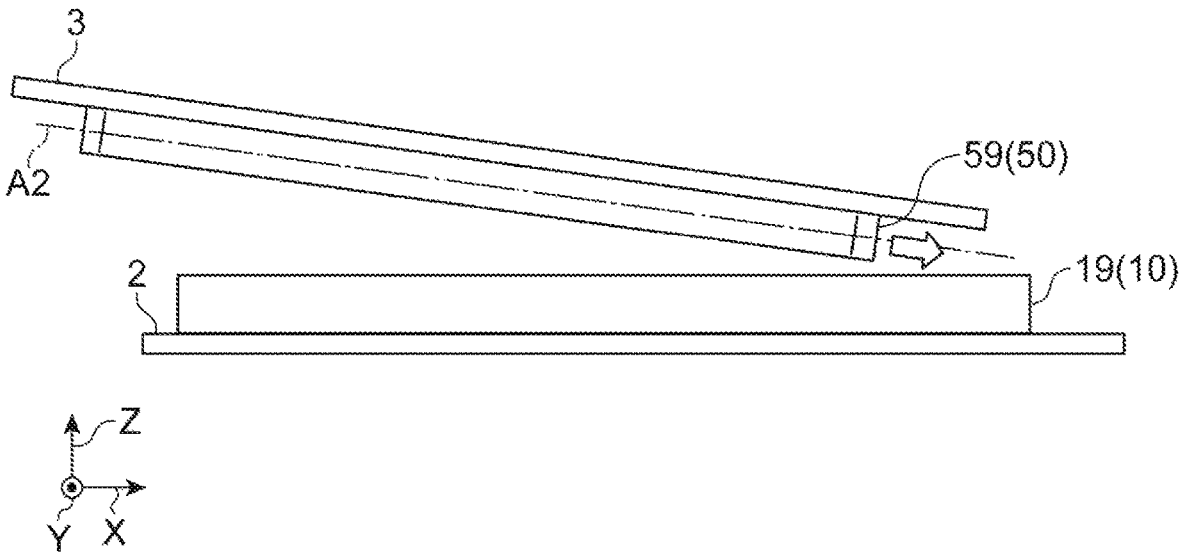
FIG. 8A is a schematic side view of a connector device before insertion.
Figure 8B:
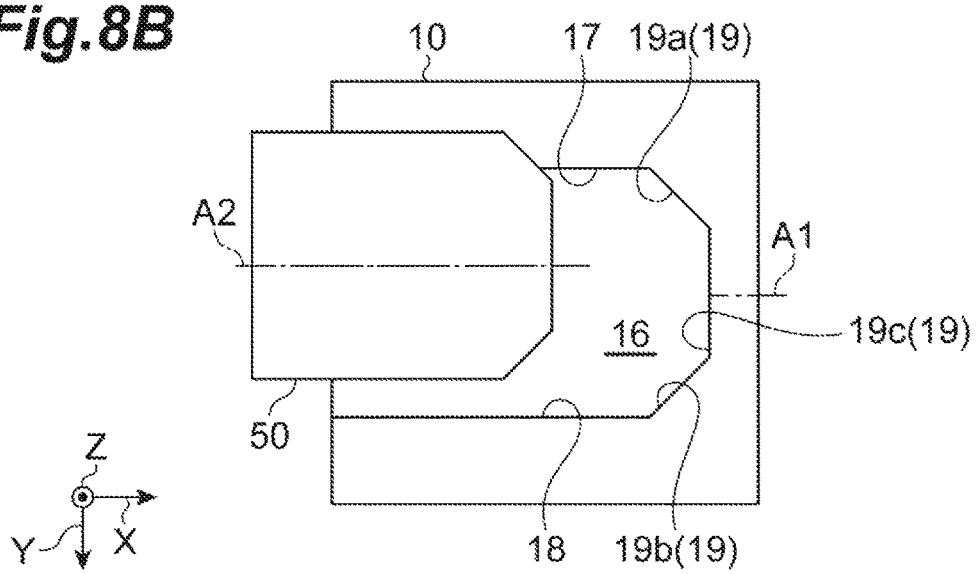
FIG. 8B is a schematic plan view of the connector device illustrated in FIG. 8A.

For example, as illustrated in FIG. 8A, it is assumed that insertion in the direction of an inclination is started. The "inclination" described here represents that the axial line A2 of the plug connector 50 is inclined with respect to the Z-axis direction. In addition, as illustrated in FIG. 8B, a state in which the plug connector 50 deviates is a state in which the axial line A2 of the plug connector 50 deviates from the axial line A1 of the receptacle connector 10 in the plan view in the Y-axis direction.

Figure 9A:
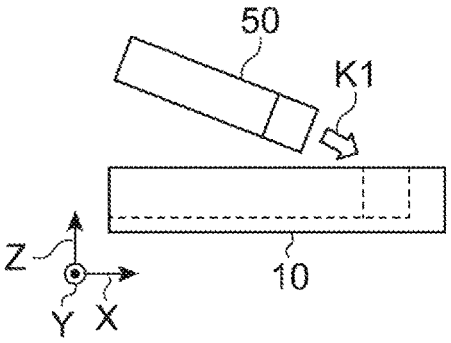
FIGS. 9A, 9B, 9C, 9D, 9E, and 9F are schematic side views of a connector device for describing a first guide function.
Figure 9B:
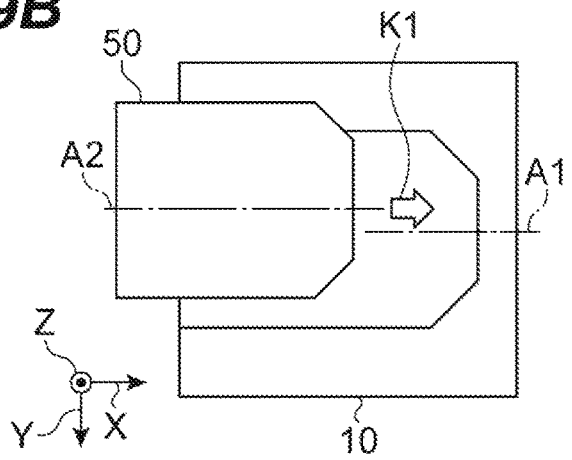
Figure 9C:
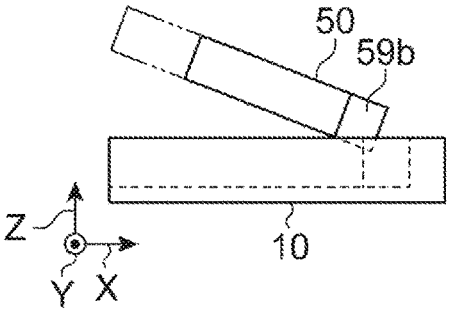
Figure 9D:
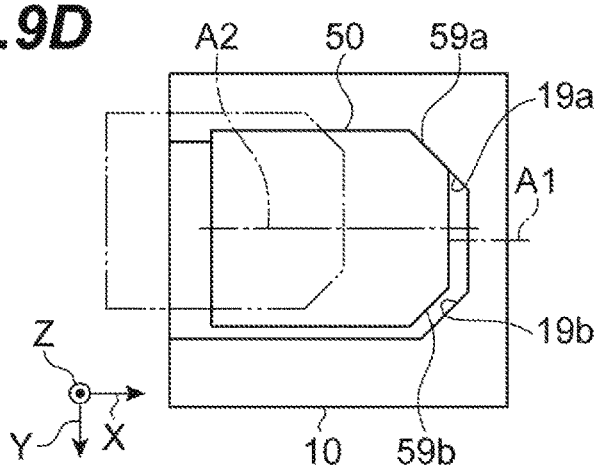
Figure 9E:
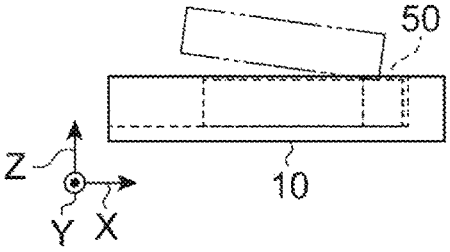
Figure 9F:
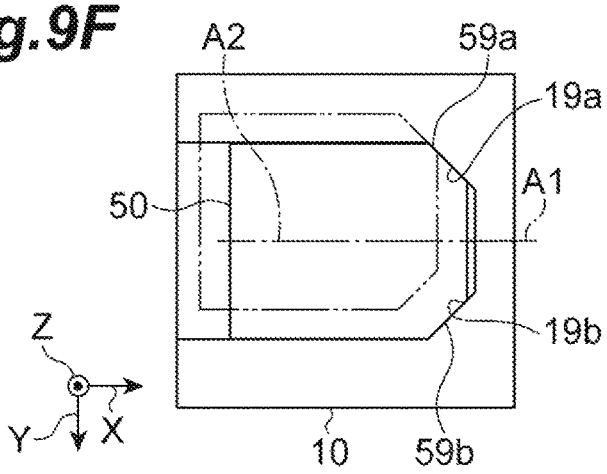

As illustrated in FIGS. 9A and 9B, insertion is started in the direction of an arrow K1 from a state in which the plug connector 50 separate from the receptacle connector 10 in the Z-axis direction (see FIG. 9A). At this time, the axial line A2 of the plug connector 50 deviates from the axial line A1 of the receptacle connector 10 in the Y-axis direction (see FIG. 9B). Next, as illustrated in FIGS. 9C and 9D, the first plug guide face 59*a* of the plug connector 50 is in contact with the first receptacle guide face 19*a* of the receptacle connector 10 (see FIG. 9D). At this time, the first plug guide face 59*b* of the plug connector 50 is not in contact with the first receptacle guide face 19*b* of the receptacle connector 10 (see FIG. 9D). The plug connector 50 is further inserted to be inclined in the state in which the first plug guide face 59*a* is in contact with the first receptacle guide face 19*a*. Then, the plug connector 50 moves along the first receptacle guide face 19*a*. This movement includes movement in the Y-axis direction. Accordingly, the axial line A2 of the plug connector 50 gradually approaches the axial line A1 of the receptacle connector 10. In other words, the posture of the plug connector 50 is corrected. In addition, it can be regarded that the first plug guide face 59*b* of the plug connector 50 approaches the first receptacle guide face 19*b* of the receptacle connector 10. Then, as illustrated in FIGS. 9E and 9F, the first plug guide face 59*b* of the plug connector 50 is in contact with the first receptacle guide face 19*b* of the receptacle connector 10. At this time, the axial line A2 of the plug connector 50 coincides with the axial line A1 of the receptacle connector 10. In other words, the posture of the plug connector 50 is corrected to a posture that can be fitted into the receptacle connector 10.

The premise of the description presented above is the configuration in which the receptacle connector 10 and the plug connector 50 are disposed to have line symmetry with respect to each of the axial lines A1 and A2. However, the receptacle connector 10 or the plug connector 50 may not have line symmetry with respect to each of the axial lines A1 and A2. In such a case, a state in which the plug connector 50 can be fitted represents a state in which the axial lines A1 and A2 are parallel to each other.

<Second Guide Function>

The first guide function described above, in short, is a function for correcting the posture of the plug connector 50 having the axial line A2 deviating in parallel from the axial line A1 of the receptacle connector 10. The receptacle connector 10 according to the present disclosure further achieves a second guide function. In addition to the form of a parallel deviation, the deviation of the axial line A2 may have a form of deviating to intersect the axial line A1.

Figure 10A:
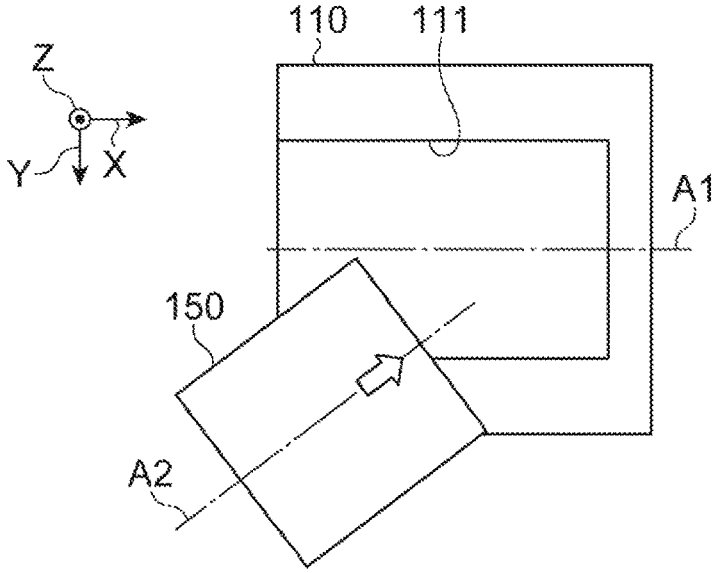
FIGS. 10A, 10B, and 10C are schematic plan views of a connector device according to a comparative example for describing a second guide function.
Figure 10B:
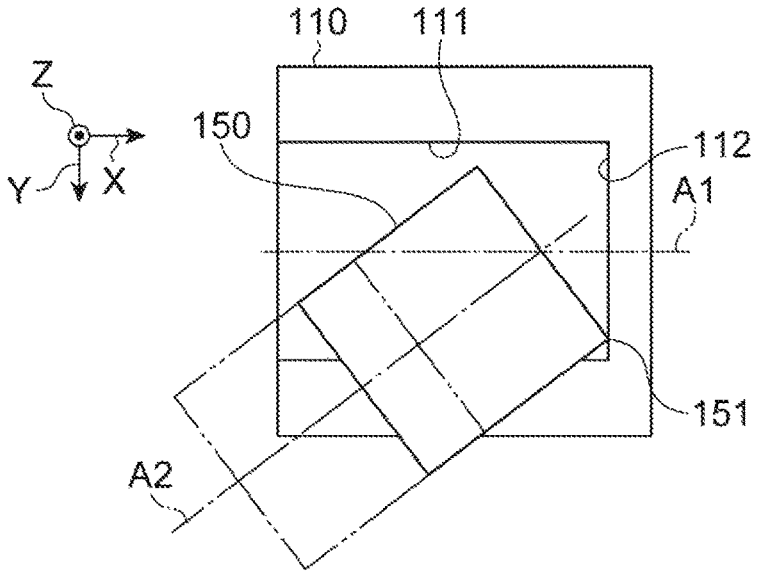
Figure 10C:
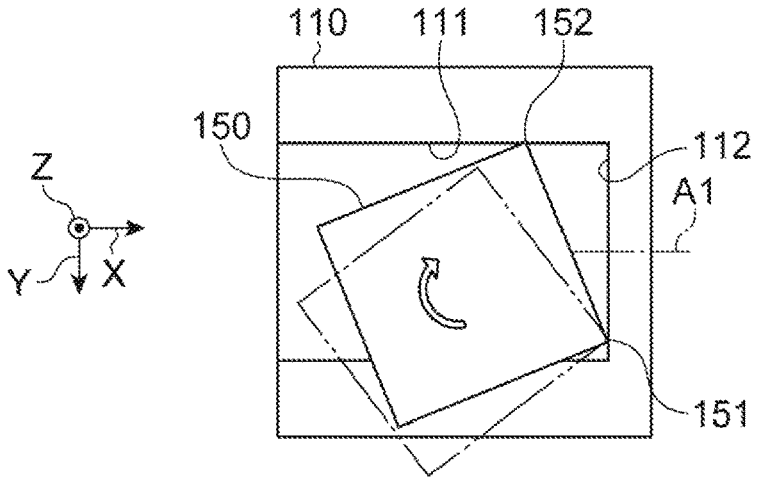
Figure 11A:
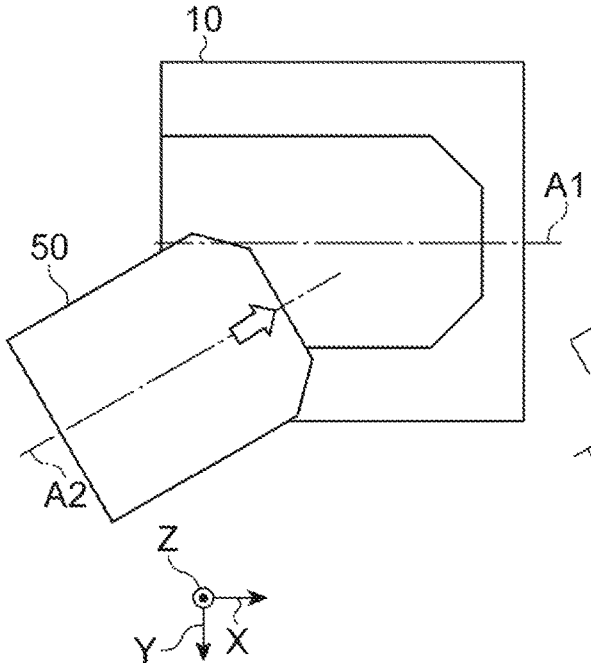
FIGS. 11A, 11B, 11C, and 11D are schematic plan views of a connector device according to the present disclosure for describing a second guide function.
Figure 11B:
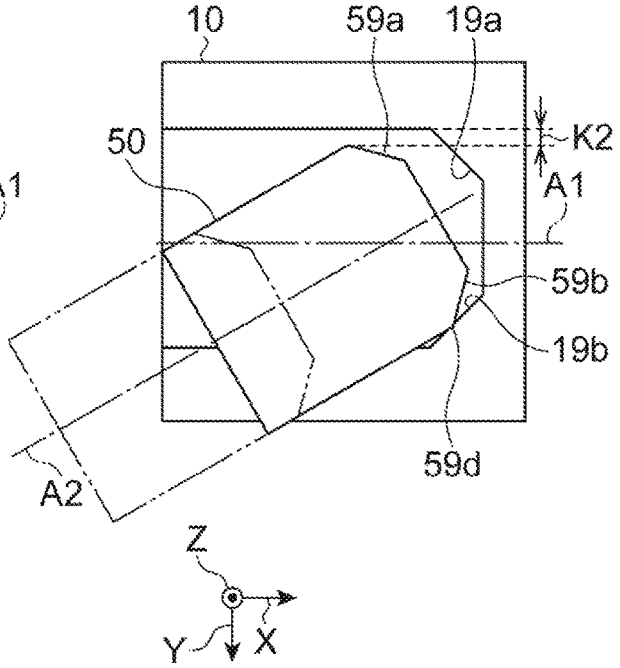
Figure 11C:
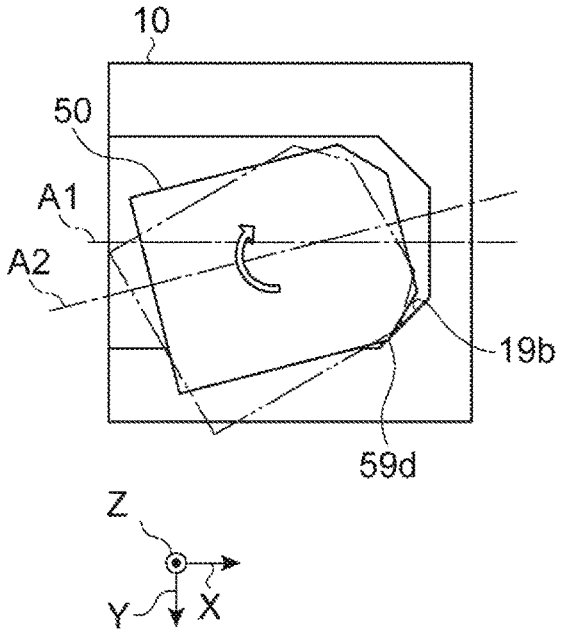
Figure 11D:
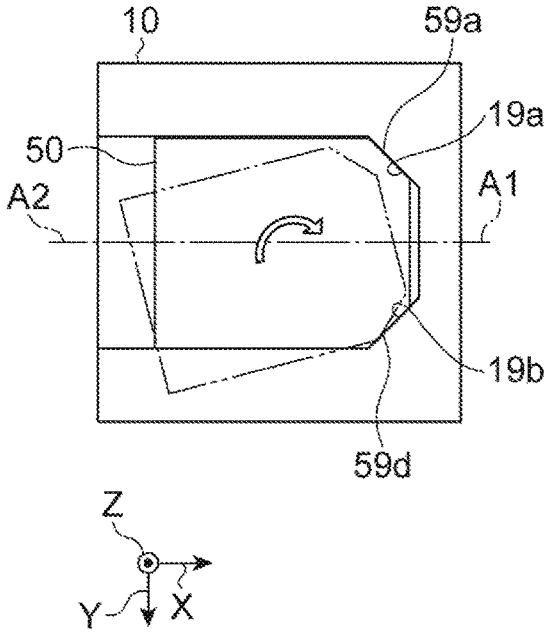

As illustrated in FIG. 10A, the axial line A2 of the plug connector 150 according to the comparative example is inclined with respect to the axial line A1 of the receptacle connector 110 in the plan view. In this state, the plug connector 150 is inserted into the receptacle connector 110 along the axial line A2. In that case, as illustrated in FIG. 10B, one corner portion 151 of the plug connector 150 may be in contact with a receptacle tip end face 112 of the receptacle connector 110. In order to correct a deviation of the plug connector 150, the plug connector 150 is rotated around the Z-axis direction. However, as illustrated in FIG. 10C, the other corner portion 152 is brought into contact with the principal inner wall face 111. Thus, the plug connector 150 cannot be rotated further. In other words, the plug connector 150 cannot correct the posture.

On the other hand, as illustrated in FIGS. 11A, 11B, 11C, and 11D, according to the receptacle connector 10 of the present disclosure, the plug connector 50 is inserted in a state (see FIG. 11A) in which the axial line A2 of the plug connector 50 is inclined with respect to the axial line A1 of the receptacle connector 10. Next, the first receptacle guide face 19*b* is brought into contact with a corner portion 59*d* of the first plug guide face 59*b* (see FIG. 11B). In this state, a gap K2 is secured between the first plug guide face 59*a* and the first receptacle guide face 19*a*. For this reason, when the plug connector 50 is rotated around the Z-axis direction (see FIG. 11C), the first plug guide face 59*a* and the first receptacle guide face 19*a* are brought into contact with each other (see FIG. 11D). In this state, the axial line A2 of the plug connector 50 is not inclined with respect to the axial line A1 of the receptacle connector 10. Accordingly, the posture of the plug connector 50 can be corrected to a posture that can be fitted into the receptacle connector 10. Such a second guide function may be regarded also as an axial adjustment function or an alignment function.

Figure 12A:
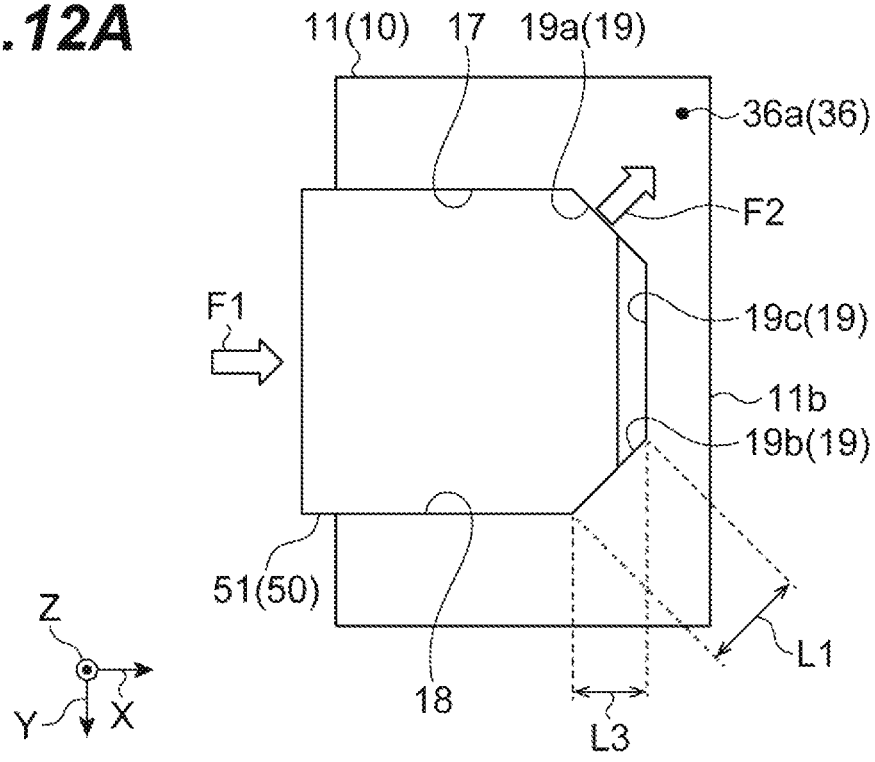
FIG. 12A is a schematic plan view of an end portion of a receptacle connector according to the present disclosure.

The configuration of the end portion of the receptacle housing 11 of the receptacle connector 10 will be described from another viewpoint. As illustrated in FIG. 12A, the first-end inner wall face 19 is formed in the end portion of the receptacle housing 11. The first-end inner wall face 19 is a part of a wall body 36 surrounding the housing portion 16. The first-end inner wall face 19 and an outer end face 11*b* form a wall portion 36*a*. Here, when the plug connector 50 is fitted into the receptacle connector 10, portions of the receptacle connector 10 with which the plug housing 51 of the plug connector 50 is brought into contact are one pair of the first receptacle guide faces 19*a* and 19*b*. For example, it is assumed that the plug connector 50 is brought into contact with the first receptacle guide face 19*a*, and an external force F1 is further applied to the plug connector 50 in the X-axis direction. In this case, the plug connector 50 presses the first receptacle guide face 19*a*. A pressing force F2 is vertically applied to the first receptacle guide face 19*a*. The wall portion 36*a* has a sufficient thickness for the pressing force F2. Accordingly, the wall portion 36*a* can appropriately stand against the pressing force F2. In addition, in a case where the wall portion 36*a* is designed to have required strength, the length in the X-axis direction can be shortened. Accordingly, the length of the receptacle connector 10 in the X-axis direction can be shortened.

Figure 12B:
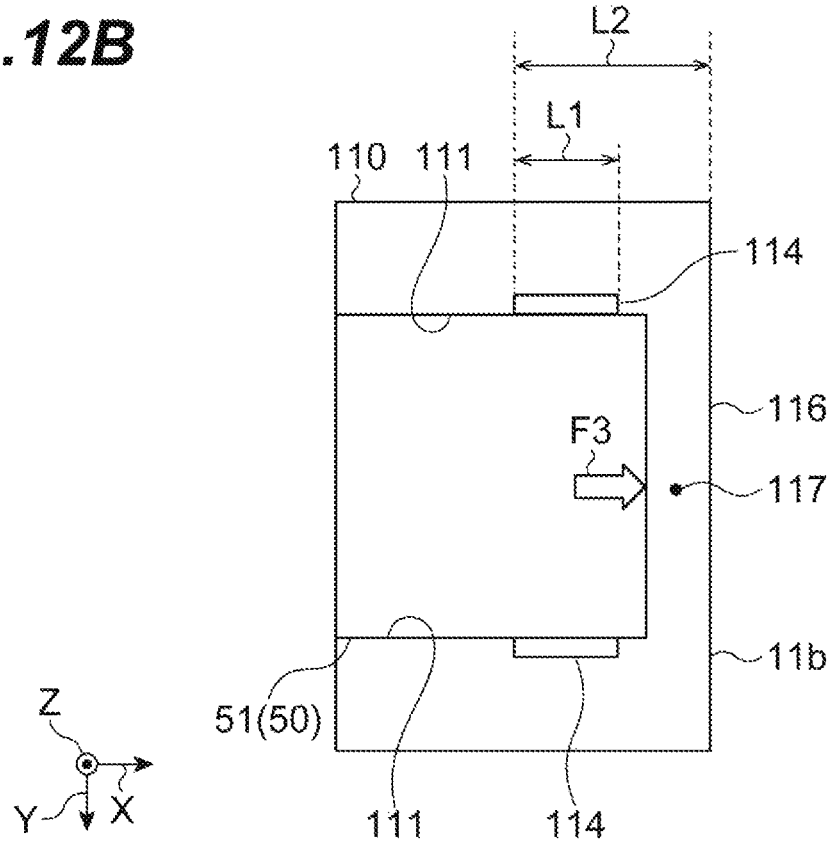
FIG. 12B is a schematic plan view of an end portion of a receptacle connector according to a comparative example.

The configuration of the end portion of the receptacle connector 10 according to the present disclosure will be further described while compared with a receptacle connector 110 according to a comparative example illustrated in FIG. 12B. FIG. 12B illustrates the receptacle connector 110 according to the comparative example. The receptacle connector 110 includes one pair of guide faces 114. The one pair of guide faces 114 are disposed on one pair of the principal inner wall faces 111. Here, it is assumed that the length (guide width) of the guide face 114 in the X-axis direction is set to a predetermined value (length L1). In this case, a length L2 from the guide face 114 to an outer end face 116 of the receptacle connector 110 is at least a length L1 or more. A portion of the receptacle connector 110 that opposes a pressing force F3 applied from the plug connector 150 is an end wall 117. Thus, it is necessary to configure the end wall 117 to have a thickness having sufficient strength.

FIG. 12A illustrates the receptacle connector 10 according to the present disclosure. One pair of the first receptacle guide faces 19*a* and 19*b* of the receptacle connector 10 are formed to be inclined with respect to the X-axis direction. Here, a length L1 is a length along the surface of the first receptacle guide face 19*a*. A length L3 is a length of the first receptacle guide face 19*a* along the X-axis direction. According to such a configuration, the length L3 is a cosine component of the length L1. In addition, the length L3 is the length of the first receptacle guide face 19*a* of the receptacle connector 10. The length L1 is the length of the guide face 114 of the receptacle connector 110. Then, when compared as the lengths in the X-axis direction, the length L3 is shorter than the length L1. In addition, as described above, in the receptacle connector 10 according to the present disclosure, the wall portion 36*a* is responsible for an external force F1 applied from the plug connector 50. In addition, a gap is arranged between the receptacle tip end face 19*c* and the plug tip end face 59*c*. Accordingly, no pressing force is applied from the plug connector 50. For this reason, the end wall configured by the receptacle tip end face 19*c* is not required to have a thickness that is about the thickness of the end wall 117 according to the comparative example. Accordingly, the receptacle connector 10 according to the present disclosure may be configured to have a length in the X-axis direction to be shorter than the receptacle connector 110 according to the comparative example.

A first chamfer 37 of the receptacle connector 10 will be described with reference to FIG. 13. Subsequently, a third chamfer 77 of the plug connector 50 will be described with reference to FIG. 14. Then, a third guide function achieved when the plug connector 50 is inserted into the receptacle connector 10 will be described with reference to FIG. 16.

The first chamfer 37 illustrated in FIG. 13 will be described. A second chamfer 38 (see FIG. 2) has a configuration similar to that of the first chamfer 37. Thus, detailed description of the second chamfer 38 will not be presented. The housing portion 16 of the receptacle connector 10 includes an opening 16*a* receiving the plug connector 50. The opening 16*a* is formed by an end edge 17*a* of the first principal inner wall face 17, an end edge 18*a* of the second principal inner wall face 18, and an end edge 19*d* of the first-end inner wall face 19. A chamfer having a curved shape in a cross-section view is connected to the end edge 19*d* of the first-end inner wall face 19 among these.

Figure 13:
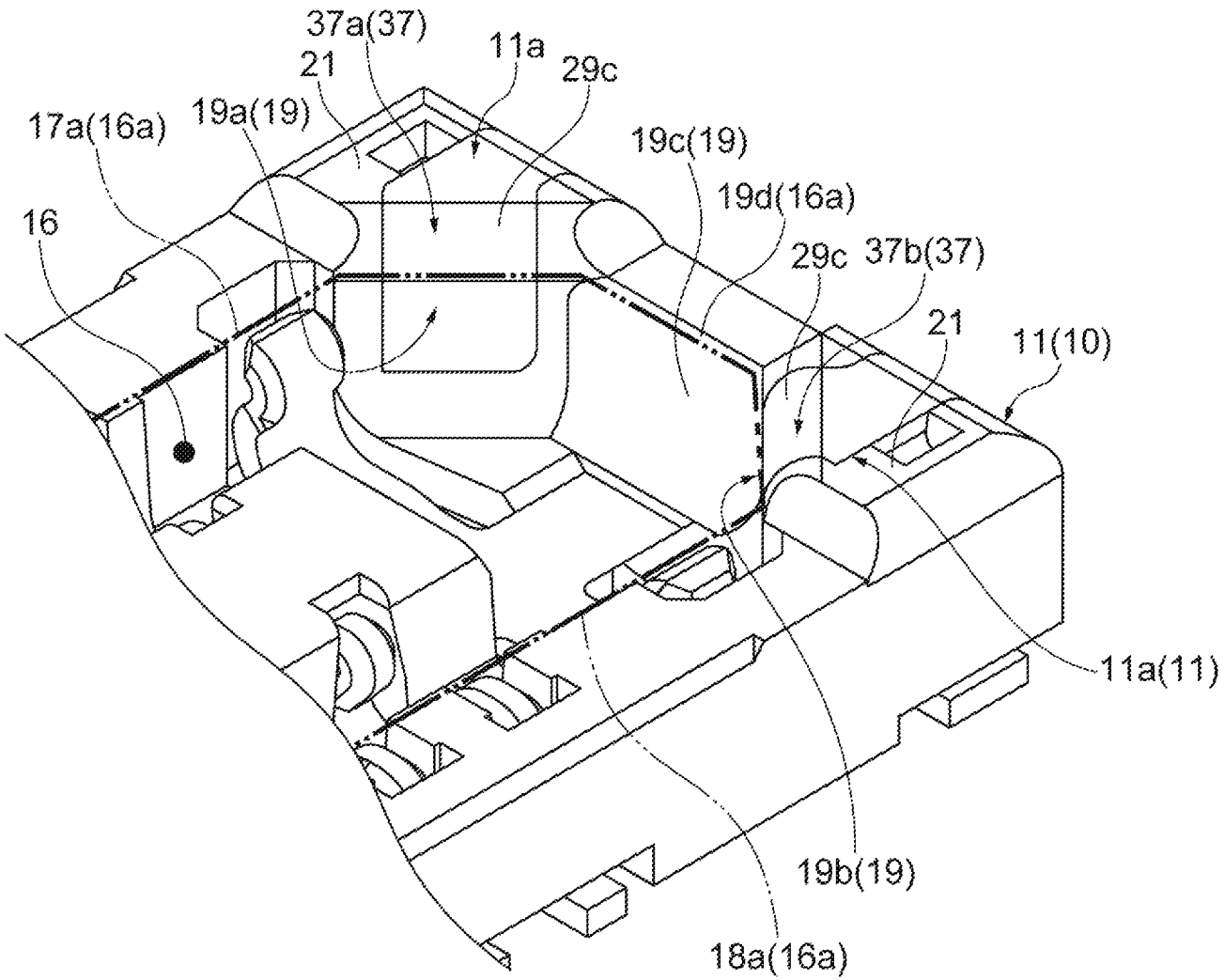
FIG. 13 is a perspective view illustrating a chamfer portion of a receptacle connector.
Figure 13:
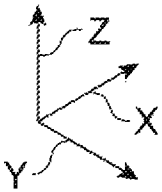

As illustrated in FIG. 13, the first chamfer 37 is connected to the end edge 19*d* of the first-end inner wall face 19. The first chamfer 37 includes a corner round portion 37*a* and a corner round portion 37*b*. A lower end of the corner round portion 37*a* is continuous to an upper end edge of the first receptacle guide face 19*a* of the first-end inner wall face 19. In addition, an upper end of the corner round portion 37*a* is continuous to the principal face 11*a* of the receptacle housing 11. The corner round portion 37*a* is configured by a part of the receptacle housing 11 and one bending portion 29*c* of the first receptacle fixing metal fitting 13. The first receptacle fixing metal fitting 13 is formed using a metal material. Accordingly, the corner round portion 37*a* includes a portion configured using the metal material. A lower end of the corner round portion 37*b* is continuous to an upper end edge of the first receptacle guide face 19*b* of the first-end inner wall face 19. An upper end of the corner round portion 37*b* is continuous to the principal face 11*a* of the receptacle housing 11. The corner round portion 37*b* is configured by a part of the receptacle housing 11 and the other bending portion 29*c* of the first receptacle fixing metal fitting 13. The first receptacle fixing metal fitting 13 is formed using a metal material. Accordingly, the corner round portion 37*b* includes a portion configured by using the metal material.

As illustrated in FIG. 14, the plug connector 50 includes a third chamfer 77 and a fourth chamfer 78 (see FIG. 1). Each of the third chamfer 77 and the fourth chamfer 78, similar to the first chamfer 37, is a corner round portion having a curved shape in a cross-sectional view. The fourth chamfer 78 (see FIG. 1) is disposed on the side of the other end of the plug housing 51. The fourth chamfer 78 has a configuration similar to that of the third chamfer 77. Thus, detailed description of the fourth chamfer 78 will not be presented.

As illustrated in FIG. 14, the third chamfer 77 is disposed on the side of one end of the plug housing 51. The corner round portion 77*a* is a part of the third chamfer 77. The corner round portion 77*a* is continuous to the first plug guide face 59*a* of the first-end outer wall face 59 and the principal face 51*a* of the plug housing 51. The corner round portion 77*a* is configured by a part of the plug housing 51 and the bending portion 69*d* of the first plug fixing metal fitting 53. Accordingly, the corner round portion 77*a* includes a portion configured using a metal material. The corner round portion 77*b* is the other part of the third chamfer 77. The corner round portion 77*b* is continuous to the first plug guide face 59*b* of the first-end outer wall face 59 and the principal face 51*a* of the plug housing 51. The corner round portion 77*b* is configured by a part of the plug housing 51 and the bending portion 69*d* of the first plug fixing metal fitting 53. Accordingly, the corner round portion 77*b* includes a portion configured using the metal material.

<Third Guide Function>

Figure 15A:
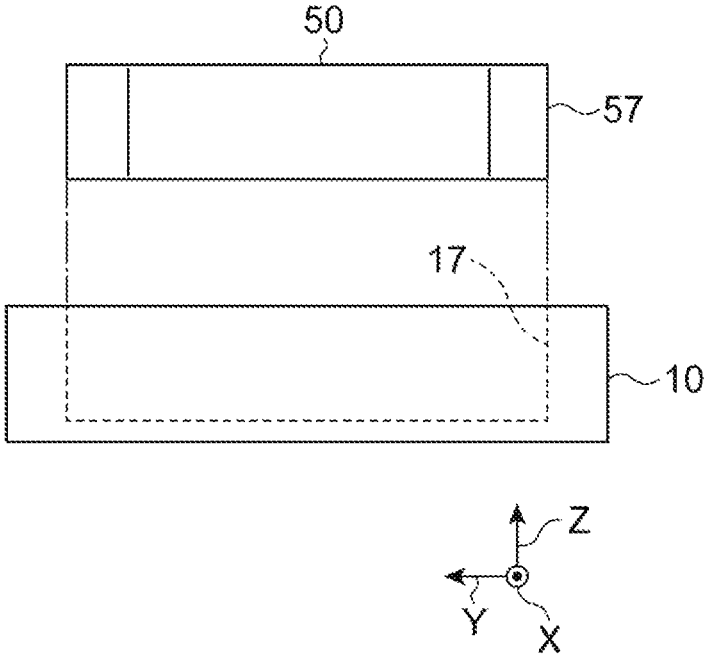
FIGS. 15A and 15B are diagrams for describing a third guide function.
Figure 15B:
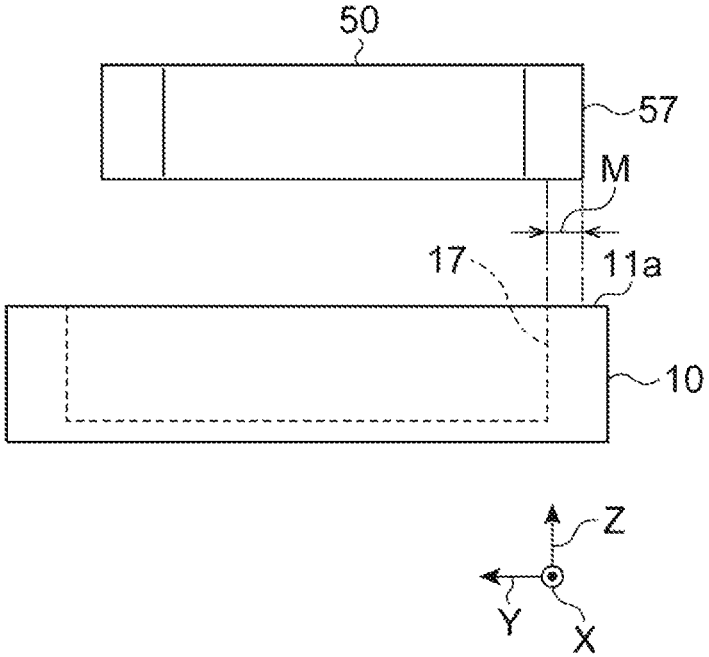

According to the chamfers 37, 38, 77, and 78 described above, a third guide function is achieved. The third guide function, in short, is a function for correcting the position of the plug connector 50 on a virtual plane orthogonal to the Z-axis direction in the plan view of the receptacle connector 10 and the plug connector 50. Described in more detail, as illustrated in FIG. 15A, there may be cases where the plug connector 50 is moved in the Z-axis direction with respect to the receptacle connector 10 and is inserted into the receptacle connector 10. In such cases, ideally, when the first principal outer wall face 57 of the plug connector 50 and the first principal inner wall face 17 of the receptacle connector 10 coincide with each other in the Y-axis direction, according to the movement in the Z-axis direction, the plug connector 50 can be inserted into the receptacle connector 10. However, actually, as illustrated in FIG. 15B, there are cases where the first principal outer wall face 57 of the plug connector 50 is positioned on the principal face 11*a* of the receptacle connector 10. In such cases, the receptacle housing 11 of the receptacle connector 10 and the plug housing 51 of the plug connector 50 interfere with each other (see an interference M in FIG. 15B).

Figure 16A:
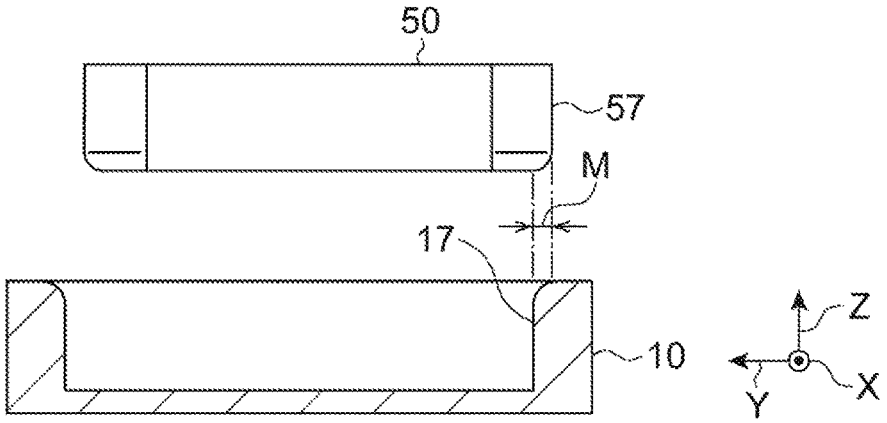
FIGS. 16A, 16B, 16C, and 16D are diagrams illustrating a third guide function.
Figure 16B:
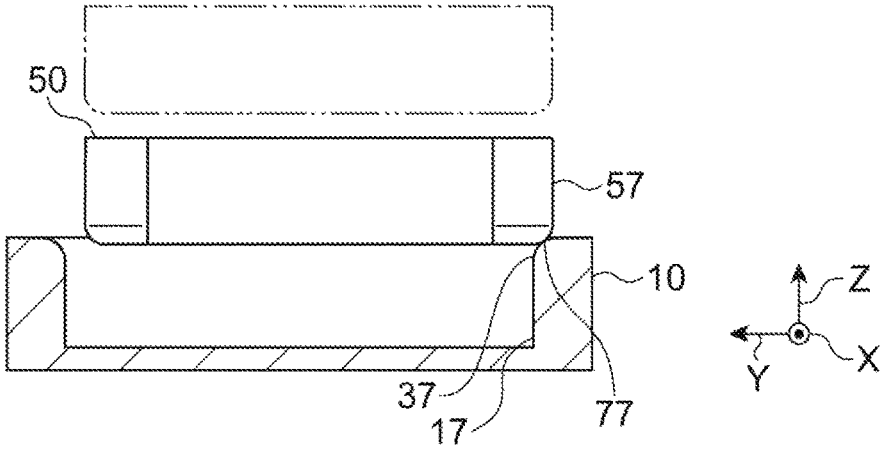
Figure 16C:
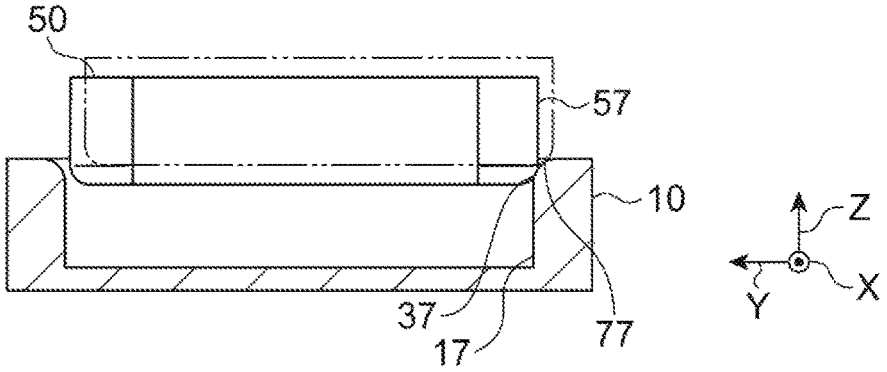
Figure 16D:
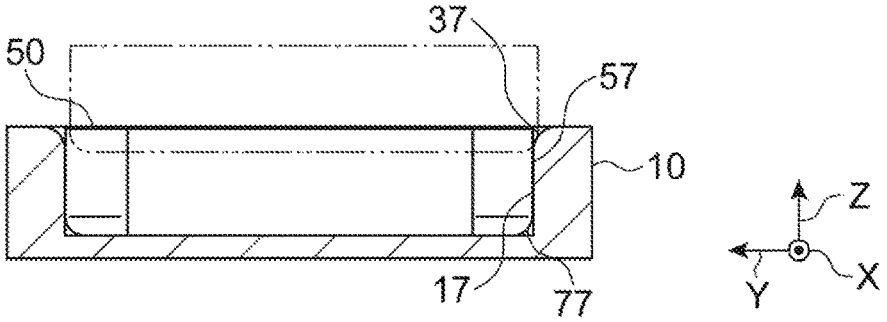

Thus, the receptacle connector 10 and the plug connector 50 according to the present disclosure include the chamfers 37, 38, 77, and 78. The third guide function achieved by the first chamfer 37 and the third chamfer 77 will be described with reference to FIGS. 16A to 16D. As illustrated in FIG. 16A, the plug connector 50 is separate from the receptacle connector 10 in the Z-axis direction. The plug connector 50 forms an interference M in the Y-axis direction. As illustrated in FIG. 16B, the plug connector 50 is moved in the Z-axis direction. Then, the third chamfer 77 of the plug connector 50 is brought into contact with the first chamfer 37 of the receptacle connector 10. As illustrated in FIG. 16C, the plug connector 50 is further moved in the Z-axis direction in the state in which the third chamfer 77 is brought into contact with the first chamfer 37. Then, the plug connector 50 also moves in the Y-axis direction while moved in the Z-axis direction passing along the surface of the first chamfer 37. The plug connector 50 is further moved in the Z-axis direction. Then, the first principal outer wall face 57 of the plug connector 50 and the first principal inner wall face 17 of the receptacle connector 10 coincides with each other in Y-axis direction. At this time point, the interference M becomes zero. Then, as illustrated in FIG. 16D, the plug connector 50 is inserted into the receptacle connector 10 in the Z-axis direction while being brought into contact with the first principal inner wall face 17 of the receptacle connector 10. According to the chamfers 37, 38, 77, and 78, even in a case where the plug connector 50 and the receptacle connector 10 interferes with each other in the Y-axis direction, a state in which the plug connector 50 interferes with the receptacle connector 10 can be resolved. Accordingly, the posture of the plug connector 50 can be corrected to a posture that can be inserted into the receptacle connector 10.

The chamfers 37, 38, 77, and 78 do not need to be included in both the receptacle connector 10 and the plug connector 50. The chamfers 37, 38, 77, and 78 may be disposed at least one of the receptacle connector 10 and the plug connector 50. For example, in a case where the chamfers 37 and 38 are included in the receptacle connector 10, the plug connector 50 may not include the chamfers 77 and 78. On the other hand, in a case where the chamfers 77 and 78 are included in the plug connector 50, the receptacle connector 10 may not include the chamfers 37 and 38.

The first guide function and the second guide function described above are targeted for a state in which a part of the plug connector 50 is inserted into the housing portion 16 of the receptacle connector 10 to a state in which the plug connector 50 is fitted. On the other hand, the third guide function is targeted for a state in which the plug connector 50 is not inserted into the housing portion 16 of the receptacle connector 10 at all to a state in which a part of the plug connector 50 is inserted into the housing portion 16 of the receptacle connector 10. For this reason, in a case where the plug connector 50 is inserted into the receptacle connector 10, first, after the third guide function is achieved, the first guide function and the second guide function are achieved. In other words, according to the chamfers 37, 38, 77, and 78 achieving the third guide function, an allowed amount of the deviation can be increased. The allowed amount of the deviation is the amount of a deviation for which the posture of the plug connector 50 can be corrected to a posture that can be inserted into the receptacle connector 10. Accordingly, by arranging the chamfers 37, 38, 77, and 78 such that the third guide function is achieved in addition to the first guide function and the second guide function, the degree of easiness in the operation of inserting the plug connector 50 into the receptacle connector 10 can be further improved. Such a third guide function may be regarded also as an alignment function.

Hereinafter, the operations and the effects of the connector device 1 and the receptacle connector 10 according to the present disclosure will be described.

An operation of assembling an electronic apparatus including a connector device includes an operation of mounting a plug connector and a receptacle connector in boards and an operation of fitting the plug connector and the receptacle connector mounted in the boards with each other after the mounting process. Here, when the boards face each other for the fitting, the plug connector and the receptacle connector are hidden by the boards. Accordingly, there are cases where an operator cannot see the plug connector and the receptacle connector. For this reason, an operator cannot perform the fitting operation through visual observation. Thus, the operator fits the plug connector into the receptacle connector by touch. For this reason, it is difficult to improve the efficiency of the operation of fitting the plug connector and the receptacle connector with each other.

In addition, in a state in which the plug connector 50 and the receptacle connector 10 are fitted with each other, the direction of the axial line of the plug connector 50 is lined up in the direction of the axial line of the receptacle connector 10. Accordingly, in order to fit the plug connector 50 into the receptacle connector 10, first, the direction of the axial line of the plug connector 50 is lined up in the direction of the axial line of the receptacle connector 10. Then, the plug connector 50 is inserted into the receptacle connector 10. While the plug connector 50 and the receptacle connector 10 are separate from each other at the beginning, when the end portion of the counterpart main body of the plug connector 50 is inserted into the housing portion 16 of the receptacle connector 10, the direction of the axial line of the plug connector 50 may deviate from the direction of the axial line of the receptacle connector 10. In this state, the plug connector 50 cannot be fitted into the receptacle connector 10.

In this embodiment, the end portion of the plug connector 50 is brought into contact with one of the wall faces configuring the housing portion 16 of the receptacle connector 10. Thus, the movement of the plug connector 50 is regulated. For example, in a case where the plug connector 50 is brought into contact with the first principal inner wall face 17, the movement of the plug connector 50 in a direction facing the first principal inner wall face 17 is regulated. In other words, the movement of the plug connector 50 in the Y-axis direction is restricted. In other words, the plug connector 50 can move in the X-axis direction.

The plug connector 50 that can move in the X-axis direction finally arrives at the first-end inner wall face 19. Also in the first receptacle guide face 19*a* of the first-end inner wall face 19, the movement of the plug connector 50 in a direction facing the first principal inner wall face 17 is regulated. In other words, the movement of the plug connector 50 in the Y-axis direction is restricted. In other words, the plug connector 50 can move along the first receptacle guide face 19*a* of the first-end inner wall face 19. In the first receptacle guide face 19*a*, the gap width HR in the facing direction gradually decreases. Thus, when the plug connector 50 is moved in the state being in contact with the first receptacle guide face 19*a*, the movement of the plug connector 50 is restricted to movement in a direction obliquely intersecting the X-axis direction. The movement in the obliquely intersecting direction has a movement component in the Y-axis direction orthogonal to the X-axis direction. For this reason, even when the plug connector 50 deviates from the receptacle connector 10 at the beginning, as the plug connector 50 moves while being in contact with the receptacle guide face 19*a*, the position of the plug connector 50 is corrected such that the direction of the axial line of the plug connector 50 is gradually lined up in the direction of the axial line of the receptacle connector 10. In other words, as the plug connector 50 moves in the state of being in contact with the first receptacle guide face 19*a*, the position of the plug connector 50 is gradually corrected to a position at which fitting can be performed. Then, finally, a state is formed in which the direction of the axial line of the plug connector 50 is lined up in the direction of the axial line of the receptacle connector 10. Accordingly, the plug connector 50 can be fitted into the receptacle connector 10. According to the receptacle connector 10, even when the position of the plug connector 50 with respect to the receptacle connector 10 at the beginning is a position at which fitting cannot be performed, the position can be corrected to a position at which fitting can be performed. Accordingly, the receptacle connector 10 can improve the efficiency of the operation of fitting the plug connector 50 and the receptacle connector 10 with each other.

According to the receptacle connector 10, even in a case where the plug connector 50 that is brought into contact with the first principal inner wall face 17 or the second principal inner wall face 18 is moved to a position in the X-axis direction, the position of the plug connector 50 with respect to the receptacle connector 10 can be corrected to a position at which fitting can be performed. Accordingly, the efficiency of the operation of fitting the plug connector 50 and the receptacle connector 10 with each other can be further improved.

In the receptacle connector 10, the first-end inner wall face 19 and the second-end inner wall face 21 exhibit planar shapes. According to such a configuration, in the plug connector 50, a movement amount in the facing direction with respect to the movement amount in the direction of the axial line can be a desired constant value.

According to the receptacle connector 10, the surface strength of each of facing portions of the first-end inner wall face 19 can be improved. In addition, the surface strength of each of facing portions of the second-end inner wall face 21 can be improved.

The receptacle connector 10 includes the first chamfer 37 and the second chamfer 38. When the plug connector 50 and the receptacle connector 10 are in a plan view, there may be cases where the plug connector 50 deviates from the receptacle connector 10. According to such a deviation, there may be cases where a physical interference M between the receptacle connector 10 and the plug connector 50 occurs. In such cases, the plug connector 50 cannot be inserted into the housing portion 16 of the receptacle connector 10. However, according to the receptacle connector 10, when the plug connector 50 is moved to the bottom side of the housing portion 16 in the state in which the plug connector 50 is in contact with the first chamfer 37 or the second chamfer 38, the plug connector 50 is moved along the surface of the first chamfer 37 or the second chamfer 38. Then, the plug connector 50 arrives at the first receptacle guide face 19*a* or the first receptacle guide face 19*b*. The first receptacle guide face 19*a* is a face to which the first chamfer 37 or the second chamfer 38 is continuous. First, the plug connector 50 arrives at one pair of the first receptacle guide faces 19*a* and 19*b*. Thereafter, the plug connector 50 can be moved to the bottom side of the housing portion 16 along the first receptacle guide face 19*a* or the first receptacle guide face 19*b*. Thus, according to the receptacle connector 10, even when the positions of the plug connector 50 and the receptacle connector 10 at the beginning are positions at which fitting cannot be performed, the position of the plug connector 50 with respect to the receptacle connector 10 can be corrected to a position at which fitting can be performed. Accordingly, the receptacle connector 10 can further improve the efficiency of the operation of fitting the plug connector 50 and the receptacle connector 10 with each other.

In the receptacle connector 10, the first chamfer 37 and the second chamfer 38 include portions formed using metal materials. According to such a configuration, the surface strength of the first chamfer 37 or the second chamfer 38 can be improved. Accordingly, the plug connector 50 brought into contact with the first chamfer 37 or the second chamfer 38 can be moved with being rubbed with the first chamfer 37 or the second chamfer 38.

As above, the present invention has been described in detail with reference to the embodiments. However, the present invention is not limited to the embodiments described above. In the present invention, various changes can be made in a range not departing from the concept of the invention.

Figure 17A:
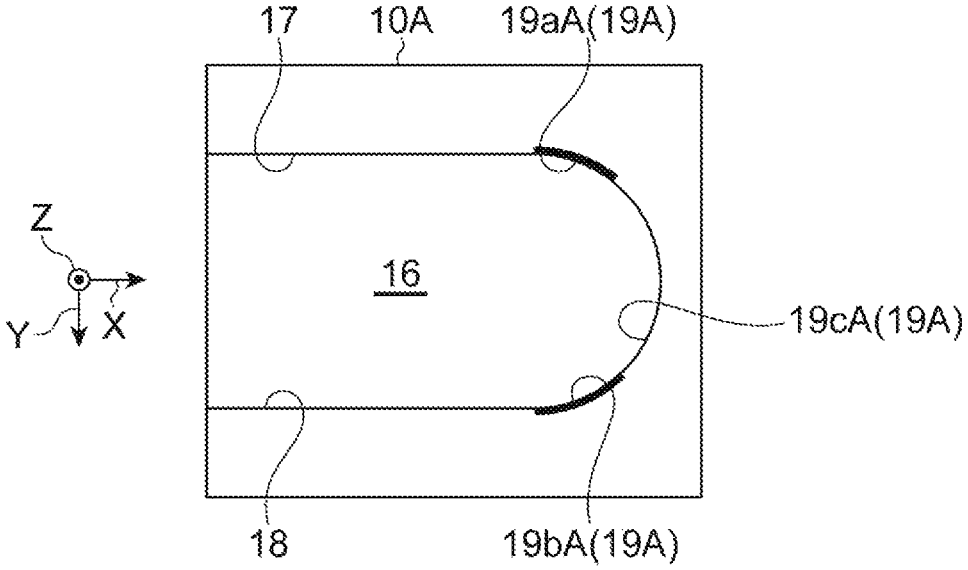
FIG. 17A is a schematic plan view of a receptacle connector according to a modified example.

In the description presented above, the first-end inner wall face 19 and the second-end inner wall face 21 have been described to have planar shapes. However, the first-end inner wall face 19 and the second-end inner wall face 21 are not limited to the planar shapes. For example, as illustrated in FIG. 17A, a first-end inner wall face 19A may have a curved shape. The first-end inner wall face 19A of a receptacle connector 10A according to Modified Example 1 illustrated in FIG. 17A exhibits an arc shape in a plan view. Also in such a configuration, in a part of the first-end inner wall face 19A, a first receptacle guide face 19*a*A and a first receptacle guide face 19*b*A having a gap width gradually decreasing in the X-axis direction are included. A receptacle tip end face 19*c*A having a curved shape is formed between the first receptacle guide face 19*a*A and the first receptacle guide face 19*b*A.

Figure 17B:
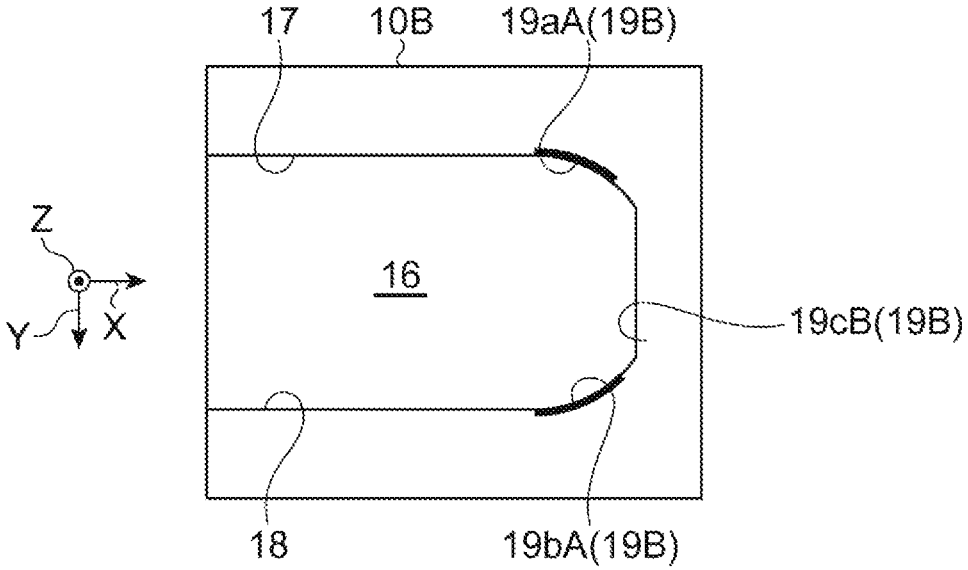
FIG. 17B is a schematic plan view of a receptacle connector according to another modified example.

In addition, as illustrated in FIG. 17B, in a receptacle connector 10B according to Modified Example 2, areas of a first-end inner wall face 19B corresponding to a first receptacle guide face 19*a*A and a first receptacle guide face 19*b*A may have curved shapes, and a receptacle tip end face 19*c*B may have a planar shape.

According to the receptacle connector 10 described above, the inclination of one pair of the first receptacle guide faces 19*a* and 19*b* with respect to the X-axis direction changes according to a position on the face. Accordingly, the ratio of the movement amount in the Y-axis direction to the movement amount in the X-axis direction can be changed.

What is claimed is:

1. An electric connector configured to enable insertion with respect to a counterpart connector, the electric connector comprising:

a main body having a principal upper surface and an accommodating portion being shaped as a depression and enabling insertion of the counterpart connector, wherein the accommodating portion is delimited from the principal upper surface along an upper edge; and main body terminals capable of being electrically connected to counterpart terminals provided on the counterpart connector when in a state where the counterpart connector is inserted into the accommodating portion, wherein the accommodating portion includes a first principal wall, a second principal wall, and a longitudinal end portion, wherein the first principal wall and the second principal wall extend in a longitudinal direction to face each other and are provided with the main body terminals, wherein the longitudinal end portion includes a first guide face adjacent an end portion of the first principal wall, a second guide face adjacent an end portion of the second principal wall, and an end face connecting the first guide face to the second guide face, wherein a gap width between the first guide face and the second guide face forms a narrowing portion, taken in a width direction at the upper edge of the accommodating portion, gradually narrowing in the longitudinal direction from a maximum width that is equal to or greater than a width of the accommodating portion between the first principal wall and the second principal wall, wherein the narrowing portion includes a portion formed by a metal fitting, and wherein the first guide face and the second guide face are each capable of abutting with the counterpart connector and a gap is formed between the end face and the counterpart connector when in a state where the counterpart connector is inserted into the accommodating portion.

2. The electric connector according to claim 1, wherein the accommodating portion includes recesses which are recessed in the width direction from the first principal wall and the second principal wall, and wherein the recesses accommodate the main body terminals.

3. The electric connector according to claim 1, wherein the first guide face and the second guide face include the portion formed by the metal fitting, and the portion formed by the metal fitting is capable of being electrically connected to second counterpart terminals different from first terminals corresponding to the counterpart terminals.

4. A connector device comprising: a plug connector having a plurality of plug terminals; and a receptacle connector configured to enable insertion with respect to the plug connector, wherein the receptacle connector includes a main body having a principal upper surface and an accommodating portion being shaped as a depression and enabling insertion of the plug connector, wherein the accommodating portion has an upper edge that delimits the accommodating portion from the principal upper surface, and receptacle terminals capable of being electrically connected to the plug terminals provided when in a state where the plug connector is inserted into the accommodating portion, wherein the accommodating portion is surrounded by a first principal wall face and a second principal wall face extending in a longitudinal direction and facing each other in a width direction of the accommodating portion and being provided with the receptacle terminals, and by a first longitudinal end portion and a second longitudinal end portion opposite the first longitudinal end portion, wherein the first longitudinal end portion includes a first guide face adjacent the first principal wall face, a second guide face adjacent the second principal wall face, and an end face connecting the first guide face to the second guide face, wherein the accommodating portion has a gap width taken in the width direction between the first guide face and the second guide face and taken at the upper edge of the accommodating portion forming a narrowing portion, and wherein the gap width gradually narrows in the longitudinal direction toward the end face, from a maximum width that is equal to or greater than a width of the accommodating portion taken between the first principal wall and the second principal wall, wherein the narrowing portion includes a portion formed by a metal fitting, and wherein the first guide face and the second guide face are each capable of abutting with the plug connector and a gap is formed between the end face and the plug connector when in a state where the plug connector is inserted into the accommodating portion.

5. The connector device according to claim 4, wherein the plug connector includes:

a pair of wall surfaces that extend longitudinally to engage with the first principal wall face and the second principal wall face, respectively, of the receptacle connector; and an end portion that extends from the pair of wall surfaces, wherein a width of the end portion gradually narrows from the pair of wall surfaces.

6. The connector device according to claim 5, wherein the pair of wall surfaces includes a first wall surface to engage the first principal wall face of the receptacle connector, and a second wall surface to engage the second principal wall face of the receptacle connector, wherein the end portion includes a tip end surface, a first guide surface extending between the first wall surface and the tip end surface, and a second guide surface extending between the second wall surface and the tip end surface, and wherein the first guide surface and the second guide surface are tapered toward the tip end surface.

7. An electric connector comprising:

a main body having a principal upper surface, and a pair of wall surfaces extending downwardly from the principal upper surface, the pair of wall surfaces forming a depression that is recessed with respect to the principal upper surface, to house a counterpart connector, wherein the pair of wall surfaces further extend in a longitudinal direction to face each other in a width direction of the depression, wherein the depression includes recesses that are recessed from the wall surfaces in the width direction, wherein the recesses accommodate main body terminals to connect with counterpart terminals of the counterpart connector, wherein the depression includes an end portion located at a longitudinal end of the depression, wherein the depression has an upper edge that delimits the depression from the principal upper surface, and wherein the end portion has a width taken at the upper edge of the depression, that gradually narrows, forming a narrowing portion, in the longitudinal direction from a maximum width that is equal to or greater than a width of the depression between the pair of wall surfaces, wherein the narrowing portion includes a portion formed by a metal fitting.

8. The electric connector according to claim 7, wherein the width of the depression between the pair of wall surfaces is taken at the upper edge of the depression.

9. The electric connector according to claim 7, wherein the recesses are additionally recessed downwardly from the principal upper surface of the main body.

10. The electric connector according to claim 7, wherein the end portion includes an end surface, and wherein the width of the end portion of the depression, narrows toward the end surface.

11. The electric connector according to claim 10, wherein the end surface includes a planar face.

12. The electric connector according to claim 11, wherein the planar face of the end surface extends in the widthwise direction of the depression.

13. The electric connector according to claim 10, wherein the end surface includes a curved surface.

14. The electric connector according to claim 10, wherein the pair of wall surfaces includes a first wall surface and a second wall surface, wherein the end portion includes a first guide surface extending between the first wall surface and the end surface, and a second guide surface extending between the second wall surface and the end surface, and wherein the first guide surface and the second guide surface are oriented to taper toward the end surface.

15. The electric connector according to claim 14, wherein the first guide surface and the second guide surface are planar.

16. The electric connector according to claim 14, wherein the first guide surface and the second guide surface are curved.

17. The electric connector according to claim 10, wherein the end portion includes a chamfer at an opening of the depression to guide the counterpart connector into the depression, wherein the chamfer is curved downwardly into the depression.

18. The electric connector according to claim 17, wherein the chamfer is located at the end surface.

* * * * *